US006595542B2

(12) United States Patent
Okajima

(10) Patent No.: US 6,595,542 B2
(45) Date of Patent: Jul. 22, 2003

(54) SNOWBOARD BINDING SYSTEM

(75) Inventor: Shinpei Okajima, Izumi (JP)

(73) Assignee: Shimano Inc., Osaka (JP)

( * ) Notice: Subject to any disclaimer, the term of this patent is extended or adjusted under 35 U.S.C. 154(b) by 0 days.

(21) Appl. No.: 09/921,305

(22) Filed: Aug. 3, 2001

(65) Prior Publication Data

US 2002/0153699 A1 Oct. 24, 2002

Related U.S. Application Data

(63) Continuation-in-part of application No. 09/836,545, filed on Apr. 18, 2001.

(51) Int. Cl.[7] ..... A63C 9/08

(52) U.S. Cl. ..... 280/613; 280/617; 280/14.22

(58) Field of Search ..... 280/613, 617, 280/618, 623, 624, 625, 626, 631, 632, 633, 11.33, 14.21, 14.22; 36/115, 117.1, 118.9, 118.7, 118.8, 118.2, 117.3, 117.2, 132, 15

(56) References Cited

U.S. PATENT DOCUMENTS 3,302,954 A * 2/1967 Elwell
4,722,613 A * 2/1988 Jungkind ..... 280/615
5,503,900 A * 4/1996 Fletcher ..... 428/160
5,505,478 A * 4/1996 Napoliello ..... 280/618
5,564,719 A * 10/1996 Kisselmann ..... 280/14.2
5,664,344 A * 9/1997 Marmonier ..... 36/118.2
5,704,139 A * 1/1998 Okajima ..... 36/115
5,722,680 A 3/1998 Dodge
5,941,553 A * 8/1999 Korman ..... 280/613
5,944,337 A * 8/1999 Girard et al. ..... 280/615
6,053,524 A * 4/2000 Laughlin ..... 280/634
6,062,586 A * 5/2000 Korman ..... 280/613
6,099,018 A 8/2000 Maravetz et al.
6,123,354 A 9/2000 Laughlin et al.
6,164,682 A 12/2000 Okajima et al.
6,213,493 B1 * 4/2001 Korman ..... 280/613
6,302,428 B1 * 10/2001 Jungkind ..... 280/624
6,315,305 B1 * 11/2001 Gien ..... 280/14.24
6,467,795 B1 * 10/2002 Hirayama et al. ..... 280/613

* cited by examiner

*Primary Examiner*—Brian L. Johnson
*Assistant Examiner*—Bridget Avery
(74) *Attorney, Agent, or Firm*—Shinjyu Global IP Counselors, LLP

(57) ABSTRACT

A snowboard binding system has a snowboard boot configured to be releasable coupled to a snowboard binding. The snowboard boot has a sole portion with a front catch and a pair of rear catches located at the lateral sides of the sole portion. The snowboard binding includes a base member, a pair of rear binding members and a front binding member. The front binding member includes a front pawl movably coupled to the front portion of the base member between a release position and a latched position and a front stop member fixedly coupled to the front portion of the base member adjacent the front pawl. The front stop member has a stop surface spaced from a latching surface of the front pawl to form a front cleat receiving area therebetween.

46 Claims, 24 Drawing Sheets

SNOWBOARD BINDING SYSTEM

CROSS-REFERENCE TO RELATED APPLICATIONS

This application is a continuation-in-part application of pending U.S. patent application Ser. No. 09/836,545 filed on Apr. 18, 2001. The entire disclosure of U.S. patent application Ser. No. 09/836,545 is hereby incorporated herein by reference.

BACKGROUND OF THE INVENTION

The present invention generally relates to a snowboard binding system for releasably coupling a snowboard boot to a snowboard. More specifically, the present invention relates to a snowboard binding that is easy to step-in and step-out of even when snow builds up between the snowboard binding and the sole portion of the snowboard boot.

Background Information

In recent years, snowboarding has become a very popular winter sport. In fact, snowboarding was also an Olympic event during the winter games at Nagano, Japan. Snowboarding is similar to skiing in that a rider rides down a snow covered hill. The snowboard is generally shaped as a small surfboard or a large skateboard without wheels. The snowboarder stands on the snowboard with his or her feet generally transverse to the longitudinal axis of the snowboard. Similar to skiing, the snowboarder wears special boots, which are fixedly secured to the snowboard by a binding mechanism. In other words, unlike skiing, the snowboarder has both feet securely attached to a single snowboard with one foot positioned in front of the other foot. The snowboarder stands with both feet on the snowboard in a direction generally transverse to the longitudinal axis of the snowboard. Moreover, unlike skiing, the snowboarder does not utilize poles.

Snowboarding is a sport that involves balance and control of movement. When steering on a downhill slope, the snowboarder leans in various directions in order to control the direction of the movement of the snowboard. Specifically, as the snowboarder leans, his or her movements must be transmitted from the boots worn by the rider to the snowboard in order to maintain control of the snowboard. For example, when a snowboarder leans backward, the movement causes the snowboard to tilt accordingly turning in the direction of the lean. Similarly, leaning forward causes the board to tilt in a corresponding manner and thus causing the snowboard to turn in that direction.

Generally, the snowboarding sport may be divided into alpine and freestyle snowboarding. In alpine snowboarding, hard boots similar to those conventionally used for alpine skiing are worn, and fitted into so-called hard bindings mounted on the snowboard, which resemble alpine ski boot bindings. In freestyle snowboarding, soft boots similar to ordinary boots are typically worn.

Boots that are used for skiing and/or snowboarding must have a high degree of rigidity for effecting steering while skiing and snowboarding. In particular, when snowboarding it is important that the rider be able to lean to the side, backward and forward with respect to the snowboard. The motion corresponding to the direction of the lean of the rider is transmitted through the boots to the snowboard (or skis) to effect turning or braking. Therefore, it is extremely important that the boots worn by the rider have sufficient rigidity to transfer such leaning motion to the snowboard or skis.

In particular, the back side of a snowboard boot must be rigid in order to provide the appropriate support for controlling movement of the snowboard. Further, as the art of snowboarding has developed, riders have found that snowboard boots provide optimal support when the back side of the snowboard boots are inclined slightly, such that the knees of the rider are always slightly bent when wearing the boots on level ground. Therefore, standing up straight with knees straight when wearing inclined snowboard boots is not always comfortable. Further, walking in such snowboard boots is sometimes awkward.

Recently, snowboard boots have been developed which allow a rider to adjust and change the inclination of inclined backside snowboard boots. For example, there are snowboard boots which include a member known as a highback support that is secured to the snowboard boot by pins which allow the highback support to pivot about the pins. The highback support extends up the back side of the boot and when locked into position fixes the back side of the boot into a predetermined inclined position that is optimal for snowboarding. When unlocked, the highback support can pivot back and allow the rider wearing the boot to stand up straight and walk more freely without having to keep the knees bent. A simple bar is used with such a boot for locking the highback support in place. Typically, the bar braces the highback support into position. An upper end of the bar is fixed to an upper portion of the highback support by a pivot pin. A lower end of the bar is configured to fit into a hook formed in a lower portion of the boot. When a rider is wearing the boots, the rider must lean forward in order to fit the bar into and out of position. The lean forward requires a significant amount of effort due to the overall rigidity of the snowboard boots and therefore the bar configuration, especially in the snow and cold, can be difficult for some riders to release and/or engage.

In recent years, snowboard bindings have been designed that securely lock to the snowboard boots, but can be released by the snowboarder after riding. Sometimes these bindings are difficult to engage due to buildup of snow and or cold. Moreover, these bindings can be difficult to release the snowboarder's boots. Furthermore, these bindings can be uncomfortable when riding the snowboard due to continued shock between the snowboard boots and the bindings.

In view of the above, there exists a need for a snowboard binding which overcomes the above mentioned problems in the prior art. This invention addresses this need in the prior art as well as other needs, which will become apparent to those skilled in the art from this disclosure.

SUMMARY OF THE INVENTION

One object of the present invention is to provide a snowboard binding that is relatively easy to step-in and step-out of.

Another object of the present invention is to provide a snowboard binding that has at least two height adjustment positions for accommodating snow between the snowboard binding and the sole of the snowboard boot.

Yet another object of the present invention is to provide a snowboard binding which eliminates the rear binding beneath the sole of the snowboard boot.

Still another object of the present invention is to provide a snowboard binding that is relatively simple and inexpensive to manufacture and assemble.

Still another object of the present invention is to provide a snowboard binding that is relatively lightweight.

Yet still another object of the present invention is to provide a snowboard binding, which reduces shock and improves power transfer between the sole of the snowboard boot and the snowboard binding.

In accordance with one aspect of the present invention, a snowboard binding is provided that comprises a base member, a rear binding arrangement and a front binding member. The base member has a front portion, a rear portion and a longitudinal axis extending between the front and rear portions. The rear binding arrangement is coupled to the rear portion of the base member. The front binding member includes a front pawl movably coupled to the front portion of the base member between a release position and a latched position and a front stop member fixedly coupled to the front portion of the base member adjacent the front pawl. The front stop member has a stop surface spaced from a latching surface of the front pawl to form a front cleat receiving area therebetween.

In accordance with another aspect of the present invention, a snowboard binding system is provided that comprises a snowboard boot and a snowboard binding. The snowboard boot has a sole portion, a front catch located at a front part of the sole portion, a first rear catch located at a first lateral side of the sole portion and a second rear catch located at a second lateral side of the sole portion. The snowboard binding is configured to be releasable coupled to the snowboard boot. The snowboard binding includes a base member, a rear binding arrangement and a front binding member. The base member has a front portion, a rear portion and a longitudinal axis extending between the front and rear portions. The rear binding arrangement is coupled to the rear portion of the base member. The front binding member includes a front pawl movably coupled to the front portion of the base member between a release position and a latched position and a front stop member fixedly coupled to the front portion of the base member adjacent the front pawl. The front stop member has a stop surface spaced from a latching surface of the front pawl to form a front cleat receiving area therebetween.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
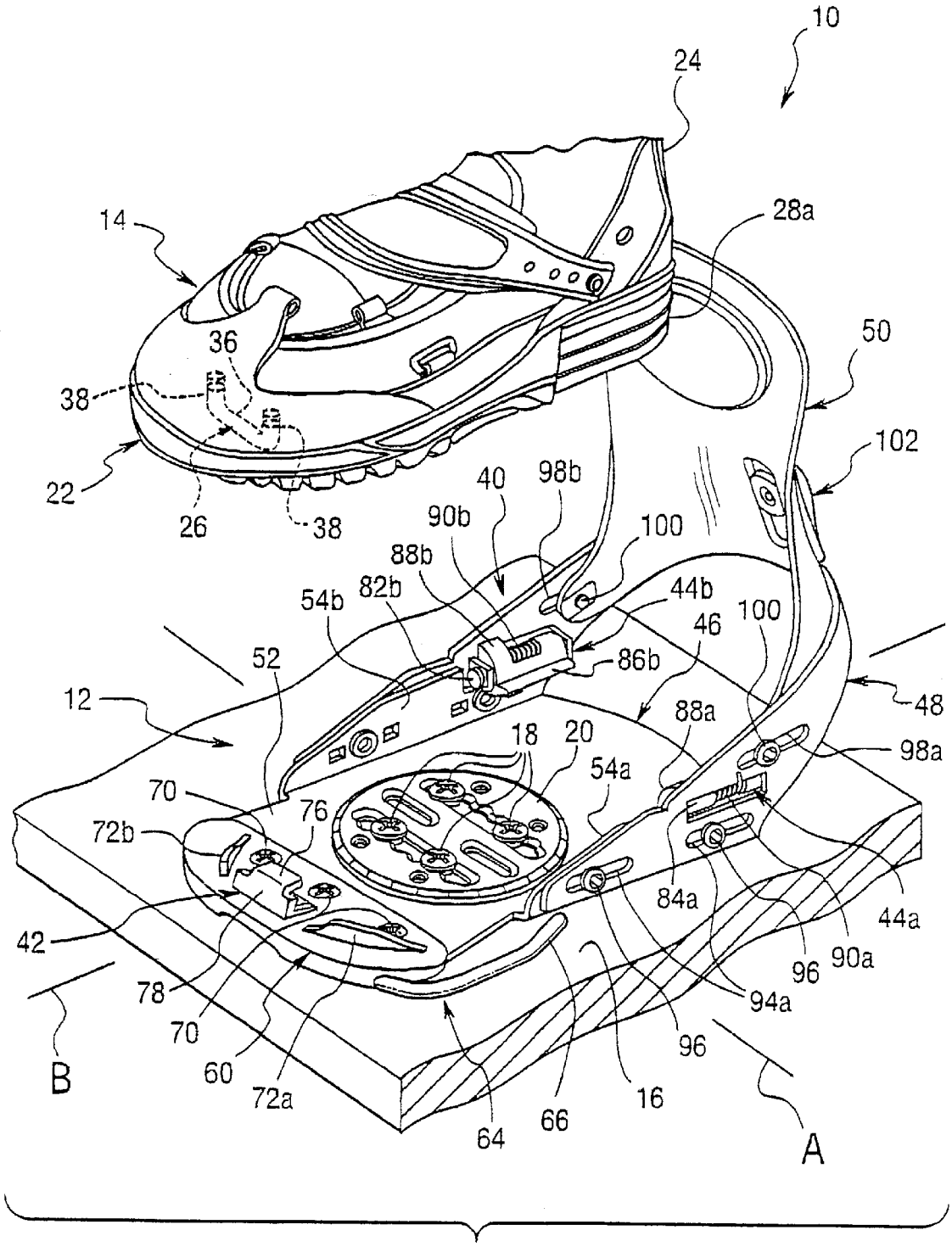
FIG. 1 is a perspective view of a snowboard binding system having a snowboard binding fixed to a snowboard and a snowboard boot in accordance with a first embodiment of the present invention.
Figure 2:
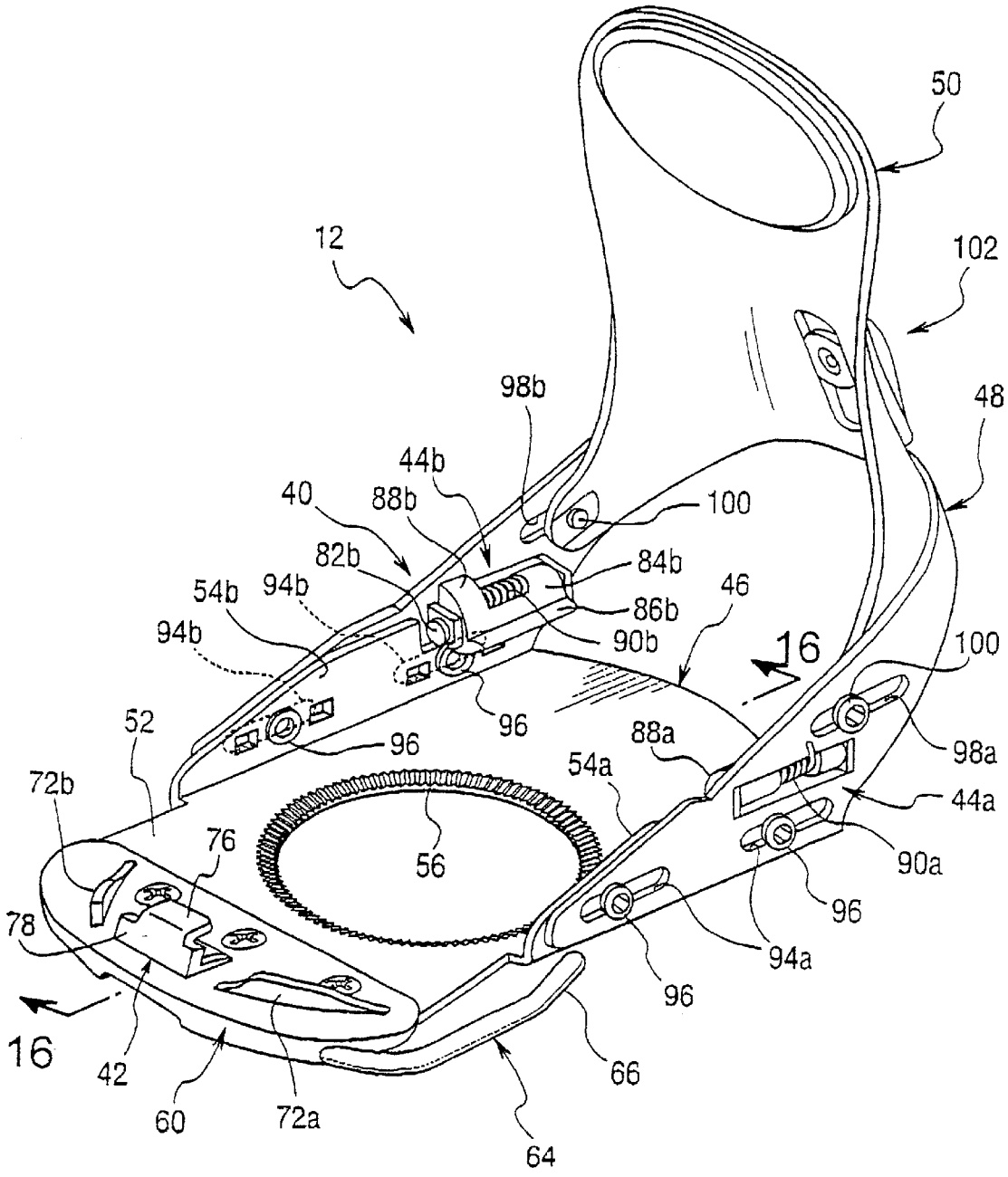
FIG. 2 is an enlarged perspective view of the snowboard binding illustrated in FIG. 1 with the snowboard binding removed from the snowboard.

Referring initially to FIGS. 1 and 2, a snowboard binding system 10 is illustrated in accordance with a preferred embodiment of the present invention. The snowboard binding system 10 basically includes a snowboard binding 12 and a snowboard boot 14. The snowboard binding 12 is attached to the top or upper surface of the snowboard 16 via four fasteners or screws 18 in a conventional manner. The longitudinal axis of the snowboard 16 is represented by the centerline A in FIG. 1. It will be apparent to those skilled in the art from this disclosure that a pair of snowboard binding systems 10 are utilized in conjunction with the snowboard 16 such that the rider has both feet firmly attached to the snowboard 16. Preferably, two adjustment disks 20 are used to adjustably couple the pair of snowboard binding systems 10 to the snowboard 16 via the screws 18. For the sake of brevity, only a single snowboard binding system 10 will be discussed and/or illustrated herein.

The snowboard boot 14 of the present invention is preferably a relatively soft or flexible snowboard boot. Soft snowboard boots are well known in the art, and thus, will not be discussed or illustrated herein. The snowboard boot 14 will not be discussed or illustrated in detail herein, except as the snowboard boot 14 relates to snowboard binding system 10 of the present invention. Basically, soft snowboard boots have a sole portion made of a stiff rubber-like material, and a flexible upper portion constructed of a variety of materials, such as plastic materials, leather and/or synthetic leather materials. Thus, the upper portion of a soft snowboard boot should be somewhat flexible.

Figure 3:
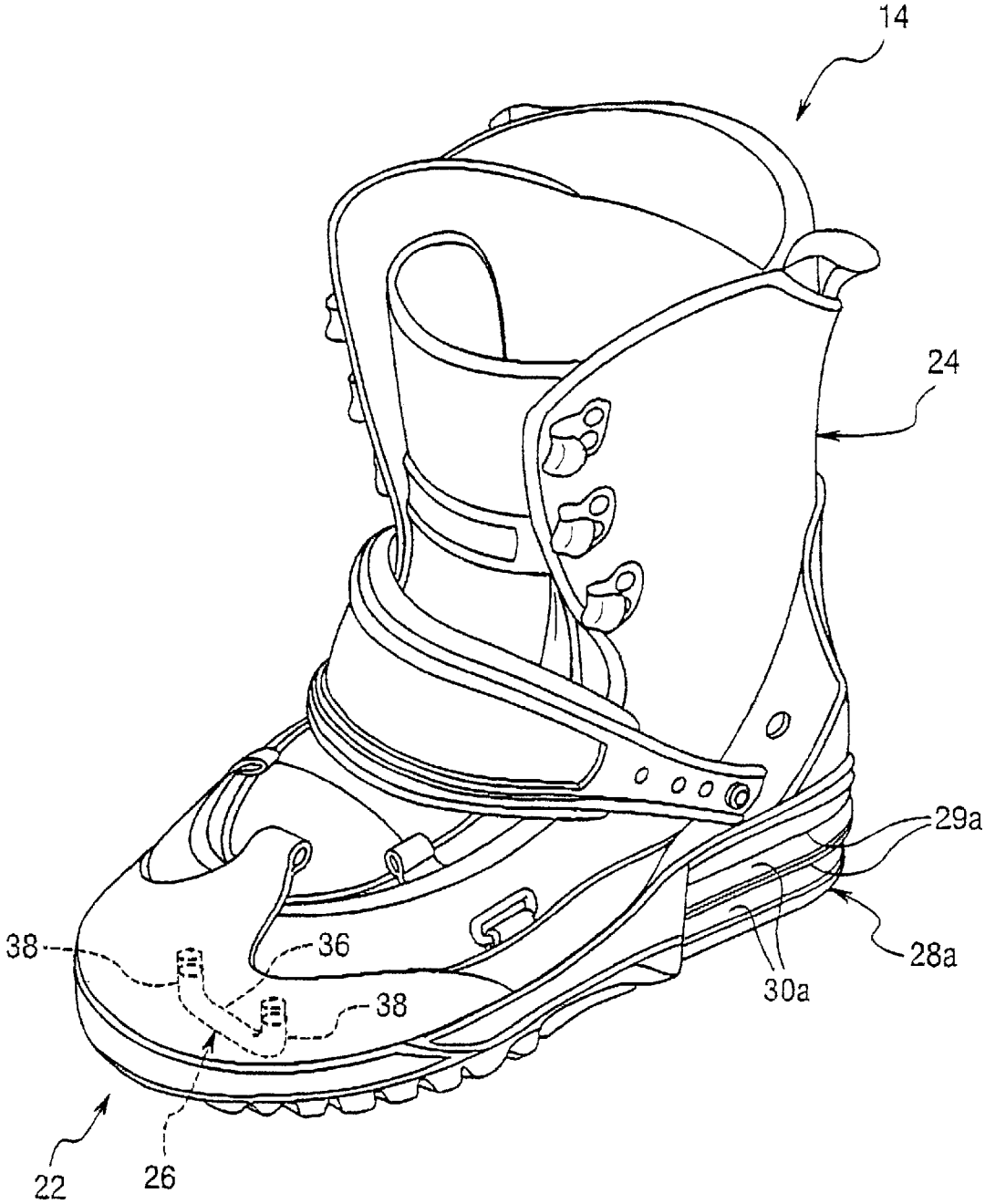
FIG. 3 is an enlarged, top perspective view of the entire snowboard boot illustrated in FIG. 1.
Figure 4:
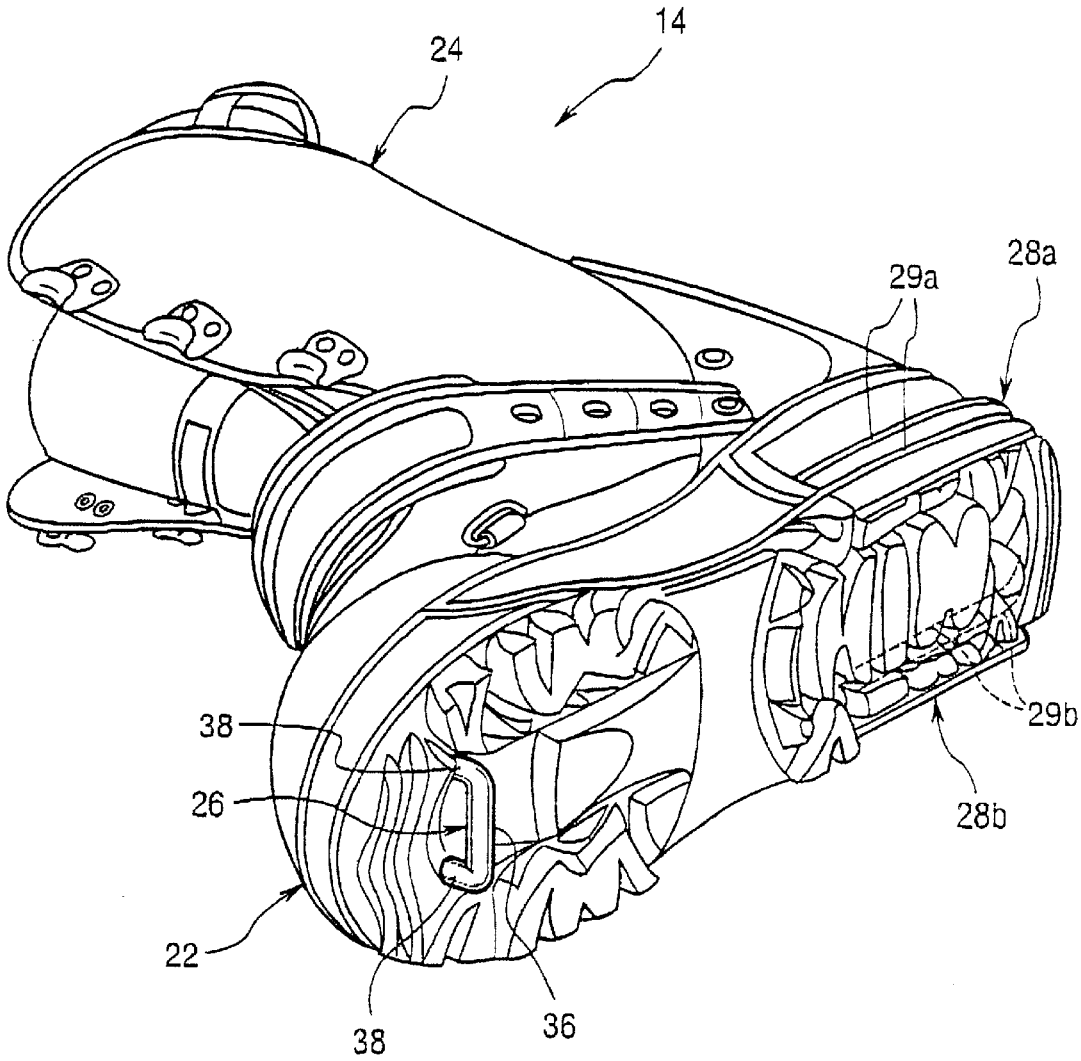
FIG. 4 is a bottom perspective view of the entire snowboard boot illustrated in FIG. 3.

The snowboard boot 14 of the present invention basically has a sole portion 22 and an upper portion 24, as seen in FIGS. 3 and 4. The upper portion 24 is not critical to the present invention, and thus, will not be discussed or illustrated in detail herein. The sole portion 22 has a front catch 26 located at a front part of the bottom surface of the sole portion 22. A first rear catch 28*a* is located at a first lateral side of the sole portion 22, while a second rear catch 28*b* is located at a second lateral side of the sole portion 22. The front catch 26 is fixedly coupled to the bottom of sole 22 of the snowboard boot 14. The rear catches 28*a* and 28*b* are preferably molded into the lateral sides of the sole portion 22.

More specifically, the front catch 26 is preferably either molded into the sole 22 of the snowboard boot 14 or attached thereto via fasteners (not shown). Referring again to FIGS. 1, 3 and 4, the front catch 26 is basically a U-shaped member with a bight portion 36 and a pair of leg portions 38 extending from the bight portion 36. As should be appreciated from this disclosure, the present invention is not limited to the precise construction of the front catch 26. Rather, the front catch 26 can be implemented in any number of ways, and the present invention is not limited to the particular implementations shown in the drawings, which are provided merely for purposes of illustration. In any event, the front catch 26 is preferably constructed of hard rigid material, such as steel or any other suitable material, and is fixedly coupled to the snowboard boot 14. The front catch 26 is configured to engage a portion of the snowboard binding 12, as discussed below in more detail.

As mentioned above, the rear catches 28*a* and 28*b* are preferably molded into the sole portion 22 of the snowboard boot 14. Alternatively, the rear catches 28*a* and 28*b* could be removable, and could attached to the snowboard boot 14 via fasteners (not shown). In any event, each of the rear catches 28*a* or 28*b* is designed to engage the snowboard binding 12 at a plurality of engagement or locked positions having different heights relative to the snowboard binding 12. More specifically, the rear catch 28*a* is formed by molding a plurality (only two illustrated) of V-shaped grooves or notches 29*a* into a (first) lateral side of the sole portion 22 of the snowboard boot 14. The rear catch 28*b* is formed by molding a plurality (only two illustrated) of V-shaped grooves into an opposite (second) lateral side of the sole portion 22 of the snowboard boot 14.

Preferably, each of the notches 29*a* has an abutment surface 30*a* angled relative to the bottom surface of sole portion 22, while each of the notches 29*b* has an abutment surface 30*b* angled relative to the bottom surface of the sole portion 22. Preferably, each of the abutment surfaces 30*a* or 30*b* forms an angle of about thirty degrees with the bottom surface of the sole portion 22. In other words, abutment surfaces 30*a* and 30*b* taper downwardly away from a center plane of snowboard boot 14 and are configured to engage the snowboard binding 12 to prevent upward movement of snowboard boot 14 relative to the snowboard binding 12. The notches 29*a* and 29*b* also preferably have a depth sufficient to prevent upward movement of the snowboard boot 14 relative to the snowboard binding 12, and are configured/shaped to mate with the snowboard binding 12.

Of course, it will be apparent to those skilled in the art from this disclosure, that the snowboard boot 14 could be designed to have additional engagement or locked positions at different heights if needed and/or desired. For example, the snowboard boot 14 could be designed to have three different engagement positions with three different heights (i.e. three V-shaped grooves), respectively. However, it should be appreciated from this disclosure that the present invention is not limited to the precise construction of the rear catches 28*a* and 28*b*. Rather, the rear catches 28*a* and 28*b* can be implemented in any number of ways, and the present invention is not limited to the particular implementations shown in the drawings, which are provided merely for the purposes of illustration.

Referring again to FIGS. 1 and 2, the snowboard binding 12 is preferably a highback binding that applies a forward leaning force on the snowboard boot 14. The snowboard binding 12 basically has a base member 40, a front binding member 42 and a pair (first and second) of rear binding members 44*a* and 44*b*. The front binding member 42 is movably coupled to the base member 40 between a release position and a latched position. The pair (first and second) of rear binding members 44*a* and 44*b* are coupled to opposite lateral sides of the base member 40 as discussed in more detail below.

The base member 40 basically includes a base plate 46 adjustably coupled to the snowboard 16 via the adjustment disk 20, a heel cup 48 adjustably coupled to the base plate 46 and a highback 50 adjustably coupled to the heel cup 48. The snowboard binding 12 is preferably adjustably coupled to snowboard 16 via the adjustment disk 20. The rear binding members 44*a* and 44*b* are movable relative to the base member 40 to selectively hold the snowboard boot 14 thereto. The rear binding members 44*a* and 44*b* are arranged to move laterally apart relative to each other from the initial rest positions (FIG. 9) to the guide positions (FIG. 10) upon application of a force in a direction substantially towards the base member 40. The rear binding members 44*a* and 44*b* are also arranged to move laterally toward each other or together to one of the locked positions (FIG. 11 or FIG. 12) upon removal of the force. Thus, the rear binding members 44*a* and 44*b* are arranged to selectively hold the snowboard boot 14 in a plurality of engagement or locked positions having different heights above the base member 40.

The adjustment disk 20 is attached to the snowboard 16 via fasteners or screws 18 that clamp the base plate 46 of the base member 40 to the top surface of the snowboard 16, as seen in FIG. 1. Accordingly, the base member 40 is angularly adjustable relative to the adjustment disk 20 and the snowboard 16 by loosening the fasteners or screws 18. Of course, the base plate 46 of the base member 40 could be attached directly to the snowboard 16, as needed and/or desired. It should be appreciated by those skilled in the art from this disclosure that the attachment of the base member 40 to the snowboard 16 can be accomplished in a number of ways. Moreover, the present invention is not limited to any particular implementation.

Figure 17:
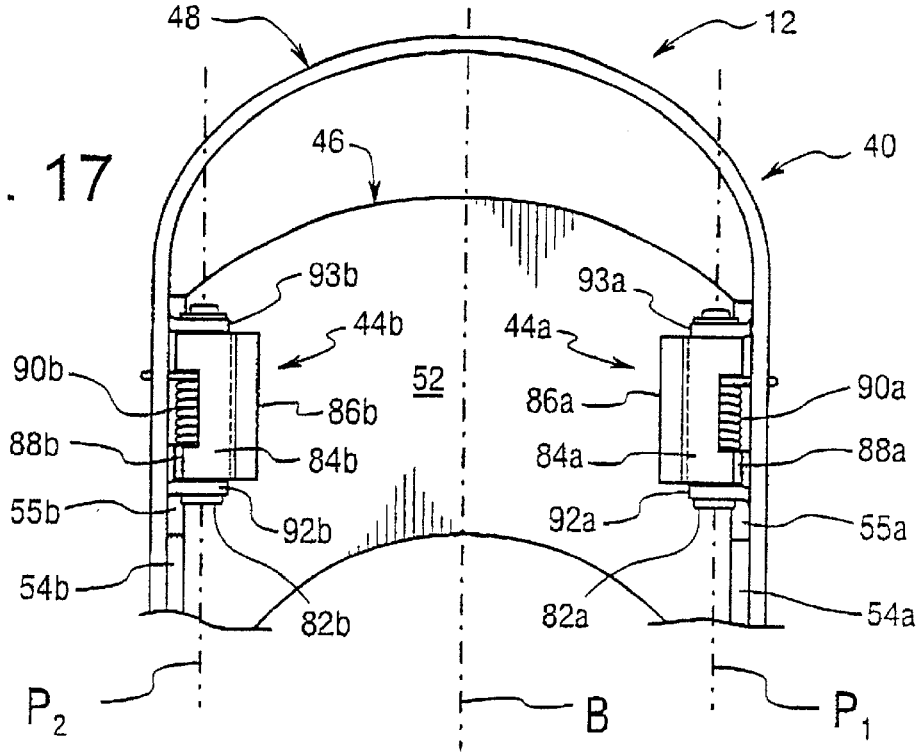
FIG. 17 is a diagrammatic, top plan view of a portion of the snowboard binding illustrated in FIGS. 1, 2 and 5–16.

As seen in FIGS. 1 and 2, the base plate 46 of the base member 40 preferably has a mounting portion 52 and a pair (first and second) of side attachment sections 54*a* and 54*b*. Preferably, the base plate 46 is constructed of a hard, rigid material. Examples of suitable hard rigid materials for the base plate 46 include various metals as well as carbon and/or a metal/carbon combination. In the preferred embodiment, the mounting portion 52 and the side attachment sections 54*a* and 54*b* are formed by bending a metal sheet material. Thus, the base plate 46 is a one-piece, unitary member. The side attachment sections 54*a* and 54*b* are preferably substantially parallel to each other and perpendicular to the mounting portion 52, as seen in FIG. 17. Alternatively, the side attachment sections 54*a* and 54*b* can taper slightly outwardly from (i.e. away from) each other from the rear portion of the snowboard binding 12 toward the front portion of the snowboard binding 12, as discussed below in reference to another embodiment of the present invention. The mounting portion 52 has a central opening 56 for receiving the adjustment disk 20 therein. Preferably, the opening 56 has a beveled edge that is serrated to form teeth for engaging a corresponding bevel edge with mating teeth of the adjustment disk 20.

Figure 13:
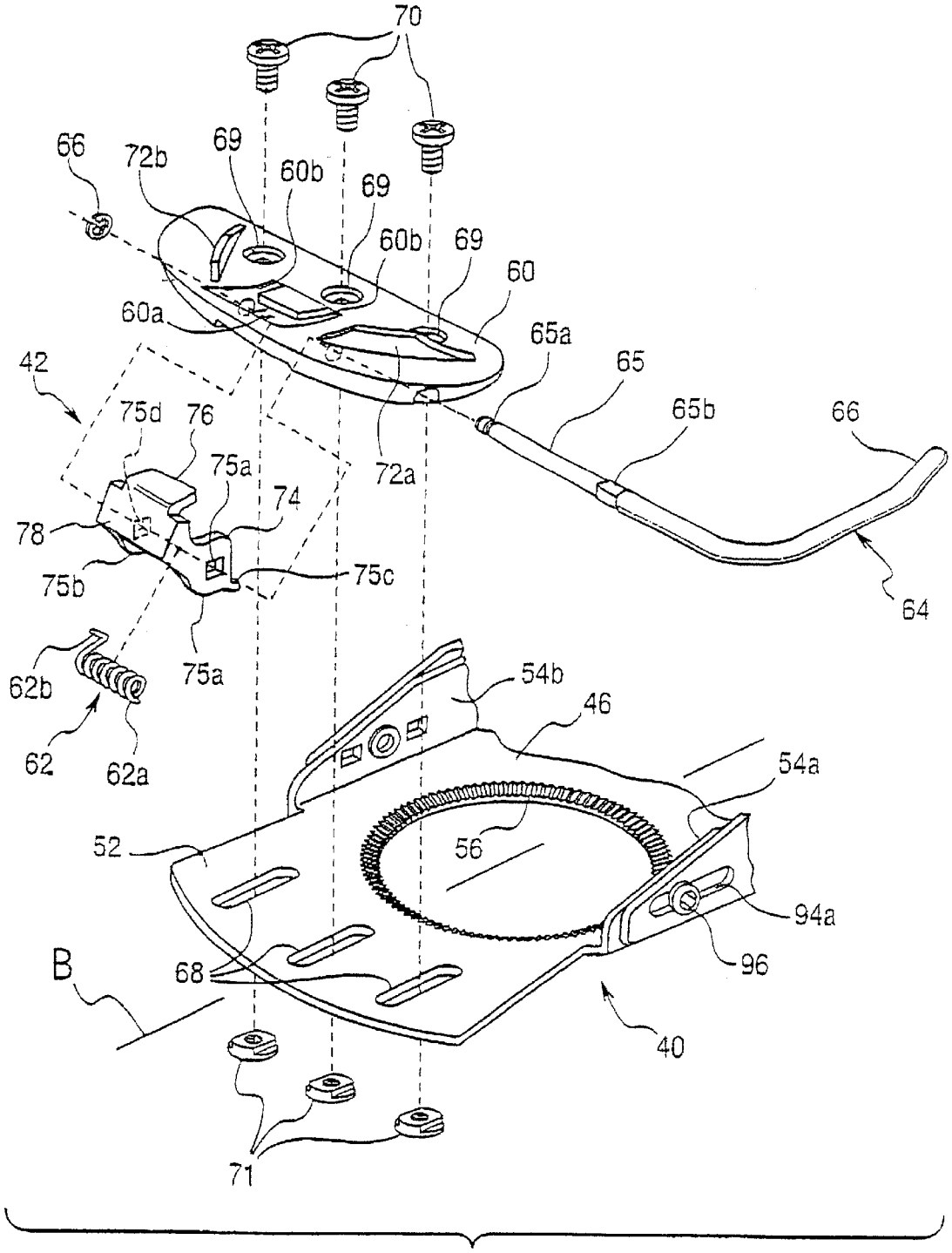
FIG. 13 is a partially exploded perspective view of the front binding member for the snowboard binding illustrated in FIGS. 1, 2 and 5–8.

As seen in FIGS. 2 and 13, the mounting portion 52 of the base plate 46 has a front binding plate 60 fixedly coupled thereto to form a front portion of the base plate 46. The front binding member 42 is movably coupled to the binding plate 60. Thus, when the binding plate 60 is fixedly coupled to the mounting portion 52, the front binding member 42 is movably coupled to the base plate 46 of the base member 40. The base member 40 has a longitudinal center axis B extending between the front portion of the base member 40 (i.e., the binding plate 60) and the rear portion of the base member 40 (i.e., the heel cup 48 and the highback 50). The front binding member 42 is preferably pivotally coupled to the binding plate 60 via a front release lever 64 which functions as a front pivot pin for the front binding member 42. A biasing member 62 is arranged on the front release lever 64 to bias the front binding member 42 toward an engaged or latched position as explained below. The control or release lever 64 is preferably non-rotatably coupled to the front binding member 42 to move the front binding member 42 against the biasing or urging force of biasing member or spring 62 from the latched position toward the release position.

The release lever 64 basically includes a pivot pin section 65 and a handle or control section 66. In other words, a part of the release lever 64 (pivot pin section 65) forms the front pivot pin of the front binding member 42. Thus, the release lever 64 is integrally formed as a one-piece, unitary member. The pivot pin section 65 preferably includes an annular recess 65*a* formed at a free end thereof. Any other suitable retaining member or C-clip 66 is received in the annular recess 65*a* to secure the release lever 64 and the front binding member 42 to the binding plate 60, with the spring 62 arranged therebetween.

Additionally, the binding plate 60 is preferably adjustable (along longitudinal axis B) relative to the mounting portion 52 of the base plate 46. More specifically, the mounting portion 52 includes a plurality (three) of slots 68, while the binding plate 60 includes a plurality (three) through holes 69. A plurality (three) of fasteners or attachment screws 70 are inserted through the holes 69 and the slots 68 and attached to the nuts 71 to fixedly couple the binding plate 60 to the mounting portion 52 in an adjustable manner along longitudinal axis B of the base member 40. Thus, the front binding member 42 can be selectively coupled at different longitudinal positions relative to the base member 40. Of course, it will be apparent to those skilled in the art that various other structures could be utilized to adjust the longitudinal position of the front binding member 42. Moreover, it will be apparent to those skilled in the art that the binding plate 60 could be integrally formed with the base plate 46 if needed and/or desired.

The binding plate 60 preferably includes a pair (first and second) of guide flanges 72*a* and 72*b* extending from an upper surface thereof, which aid in coupling the snowboard boot 14 to the snowboard binding 12. The guide flanges 72*a* and 72*b* are angled relative to longitudinal axis B of the snowboard binding 12 to guide the front catch 26 toward longitudinal axis B, and thus, toward the front binding member 42. The engagement between the snowboard boot 14 and the snowboard binding 12 will be discussed in more detail below. Additionally, the release of the snowboard boot 14 from the snowboard binding 12 via the control or the release lever 64 will also be discussed in more detail below.

As best seen in FIG. 13, the front binding member 42 basically includes a mounting portion 74, a binding flange or front pawl 76, a connecting portion 78, the biasing member 62 and the release lever 64. The mounting portion 74 is non-rotatably mounted on the pivot pin section 65 of the release lever 64 for rotation between a latched position and a release position about a front pivot axis. The front pivot axis is arranged below the binding plate 60 such that front pawl or binding flange 76 can be moved out of engagement with the front catch member 26 (i.e. to the release position). The biasing member or spring 62 urges the front pawl 76 toward the latched position. The front pawl 76 includes a lower surface configured to engage an upper surface of the bight portion 36 of the front catch 26 of the snowboard boot 14. The connecting portion 78 extends between the front pawl 76 and the mounting portion 74.

More specifically, the mounting portion 74 is preferably formed of a pair (first and second) mounting flanges 75*a* and 75*b*. The mounting flange 75*a* preferably includes a protrusion 75*c* extending therefrom. The protrusion 75*c* is designed to engage a first end 62*a* of the spring 62. The other end (second end) 62*b* of the spring 62 is designed to be received in a transverse hole (not shown) formed in the mounting plate 60. Thus, the spring 62 is preloaded to urge the front binding member 42 towards the latched position to selectively hold the front catch 26 of the snowboard boot 14. Additionally, at least one of the mounting flanges 75*a* and 75*b* preferably includes a non-circular (square) opening 75*d* to non-rotatably receive a non-circular portion 65*b* of the release lever 64. In the illustrated embodiment, both of the mounting flanges include the non-circular hole 75*d* such that the release lever 64 could be mounted to extend from either side of the binding plate 60.

The binding plate 60 includes a substantially U-shaped opening 60*a* formed therein, which is configured to partially receive the front binding member 42. A pair of the stop surfaces 60*b*, are formed at the rearmost edges of the legs of the U-shaped opening 60*a*. The stop surfaces 60*b* normally hold the front binding member 42 in the latched position. Moreover, because the pivot axis of the front binding member 42 is below bottom surface of the binding plate 60, the front binding member 42 can rotate out of contact with the front catch 26. The bottom surface of base member (i.e. the binding plate 60) forms an additional stop surface when the front binding member 42 is in the release position. In this manner, the front pawl 76 can rotate about 90 degrees from the latched position where binding flange 76 is substantially horizontal to the release position where binding flange 76 is substantially vertical.

Figure 14:
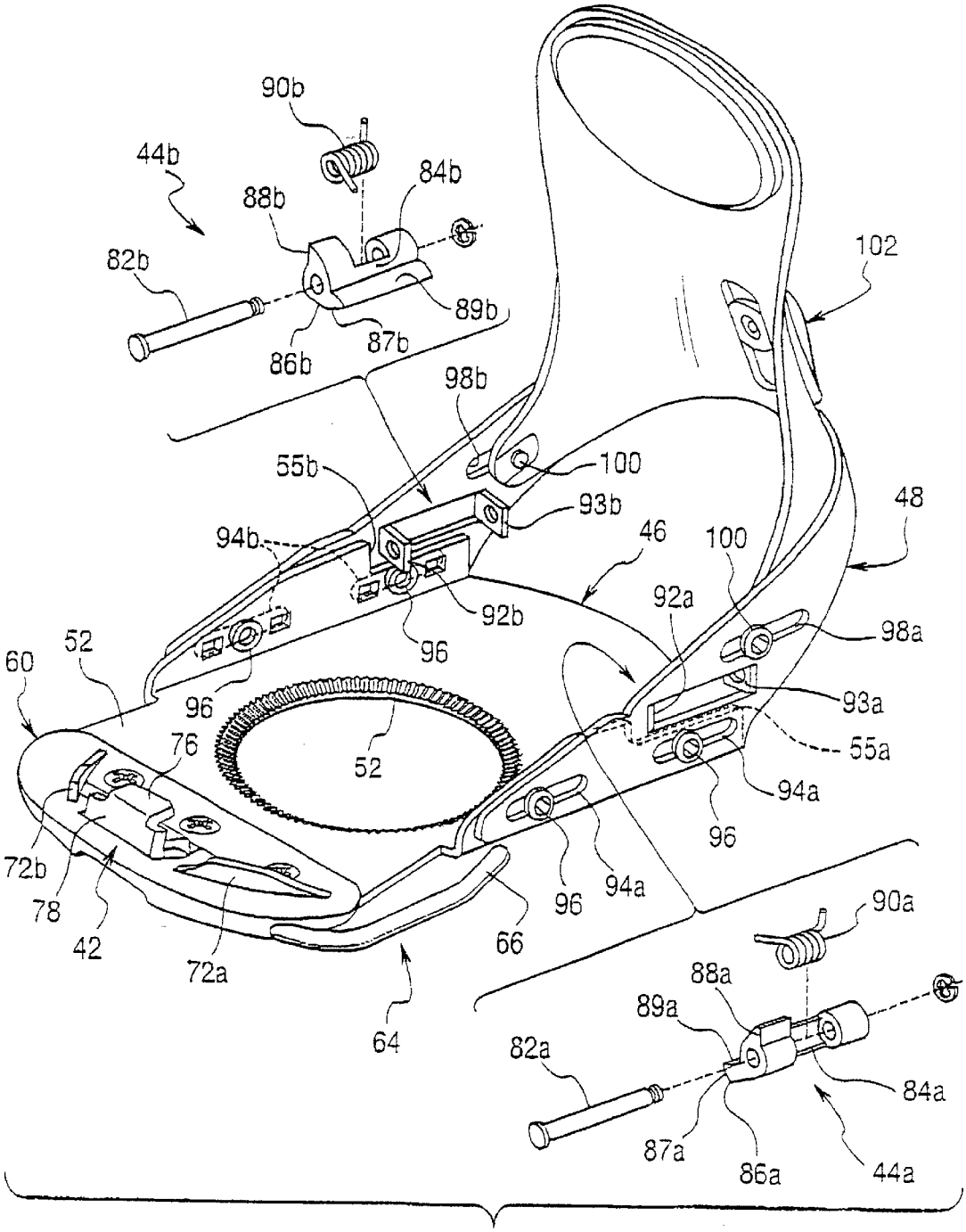
FIG. 14 is a partially exploded perspective view of the snowboard binding illustrated in FIGS. 1, 2 and 5–8 with the rear binding members removed for the purpose of illustration.
Figure 15:
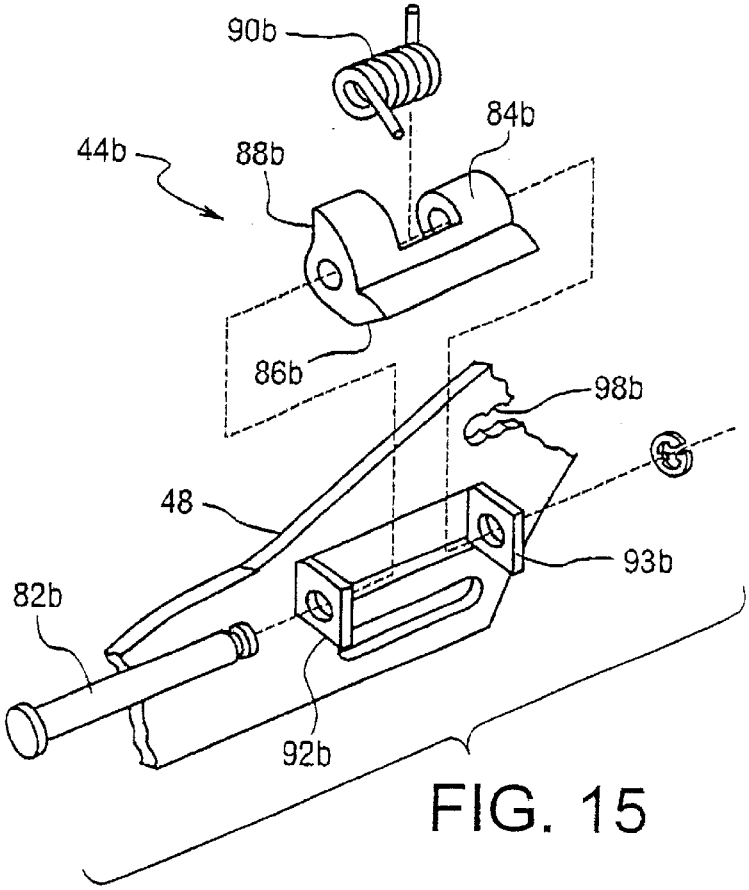
FIG. 15 is an enlarged, exploded perspective view of one of the rear binding members of the snowboard binding illustrated in FIGS. 1, 2 and 5–8.
Figure 16:
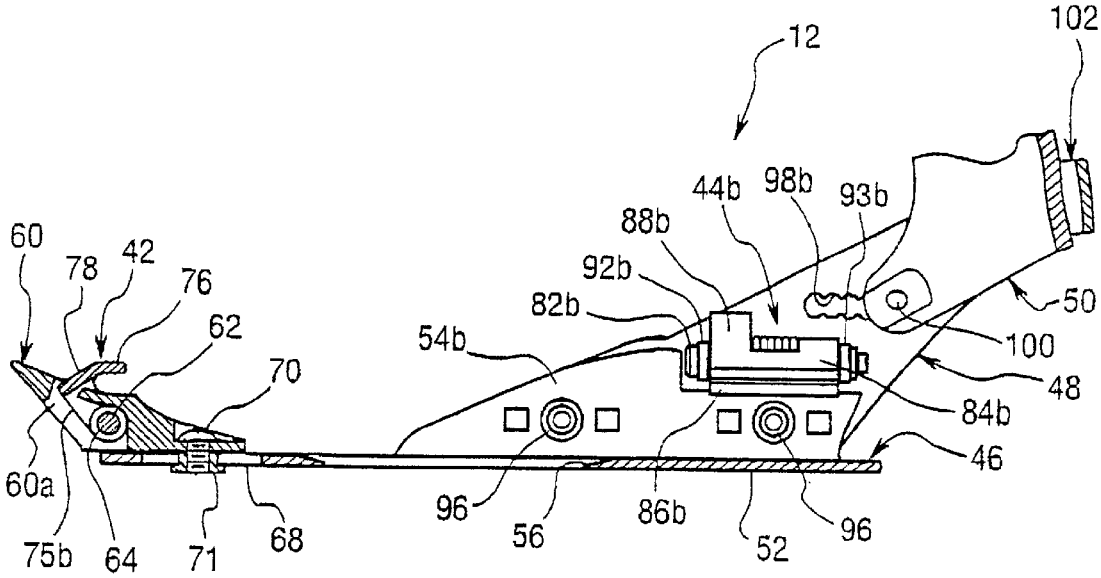
FIG. 16 is a longitudinal cross-sectional view of the snowboard binding system illustrated in FIGS. 1–15 as seen along section line 16—16 of FIG. 2.

As best seen in FIGS. 14 and 15, the rear binding members (first and second) 44*a* and 44*b* are preferably movably coupled to the heel cup 48 of the base member 40. The heel cup 48 is adjustably coupled to the attachment sections 54*a* and 54*b* of the base plate 46 to form a pair (first and second) side attachment portions, as discussed in more detail below. Thus, the rear binding members 44*a* and 44*b* are movably coupled to the base plate 46. The attachment sections 54*a* and 54*b* each include a cutout 55*a* or 55*b*, respectively. The cutouts 55*a* and 55*b* are configured to allow the heel cup 48, with the rear binding members 44*a* and 44*b* coupled thereto, to be adjustably mounted to the base plate 46. Thus, the rear binding members 44*a* and 44*b* are adjustably and movably coupled to the base member 40.

More specifically, the rear binding members 44*a* and 44*b* are pivotally coupled to the base member 40 about a pair (first and second) of the pivot axes $P_1$ and $P_2$, respectively. Preferably, the first and second pivot axes $P_1$ and $P_2$ are substantially parallel to each other, and substantially parallel to the longitudinal axis B of the snowboard binding 12 as seen in FIG. 17. This arrangement aids in releasing the snowboard boot 14 from the snowboard binding 12, as discussed in more detail below. Of course these center axes could be angled relative to the longitudinal axis B as discussed below in reference to another embodiment of the present invention.

The rear binding members 44*a* and 44*b* are preferably substantially mirror images of each other. The rear binding member 44*a* basically includes a (first) pivot pin 82*a*, a (first) body portion 84*a*, a (first) latch member 86*a*, a (first) stop member 88*a* and a (first) biasing member 90*a*. The rear binding member 44*b* basically includes a (second) pivot pin 82*b*, a (second) body portion 84*b*, a (second) latch member 86*b*, a (second) stop member 88*b* and a (second) biasing member 90*b*, as discussed in more detail below. The biasing members or springs 90*a* and 90*b* normally bias the latch members 86*a* and 86*b* toward locked positions from guide positions, respectively, as also discussed in more detail below.

The latch members 86*a* and 86*b* are preferably substantially parallel to the longitudinal axis B and the pivot axes $P_1$ and $P_2$. In any case, the latch members 86*a* and 86*b* are configured to mate with the notches 29*a* and 29*b* of the snowboard boot 14, respectively. Alternatively, the latch members 86*a* and 86*b* can be constructed to be angled relative to the longitudinal axis B and the pivot axes $P_1$ and $P_2$ as discussed below in reference to another embodiment of the present invention. Moreover, the rear binding members 44*a* and 44*b* could be mounted to angled side attachment portions such that latch members 86*a* and 86*b* are angled relative to the longitudinal axis B, as also discussed below in reference to another embodiment of the present invention. In any event, the notches 29*a* and 29*b* of snowboard boot 14 are configured to mate with latch members 86*a* and 86*b*. In other words, if the latch member 86*a* and 86*b* are angled relative to longitudinal axis B, the notches 29*a* and 29*b* should have a corresponding angle, as discussed below in reference to the other embodiments of the present invention.

The body portion 84*a* of the binding member 44*a* is pivotally mounted on the pivot pin 82*a*. The pivot pin 82*a* is preferably a headed pivot pin with an annular groove formed at a free end thereof any other suitable retaining member or c-clip 66 is received in the annular groove to retain the rear binding member 44*a* between a pair of flanges 92*a* and 93*a* of heel cup 48. The biasing member 90*a* is preferably a coil spring with one end engaged with an outer later side surface of heel cup 48 and the opposite end engaged with the binding member 44*a* (i.e. a bottom surface of latch member 86*a*) to bias the rear binding member 44*a* toward the locked position. The latch member 86*a* extends from the body portion 84*a* and is configured to engage the grooves or notches 29*a* of the snowboard boot 14. Preferably, the latch member 86*a* forms a first pawl of rear binding member 44*a*. The stop member 88*a* also extends from the body portion 84*a* but in a substantially opposite direction from the latch member 86*a*.

Figure 9:
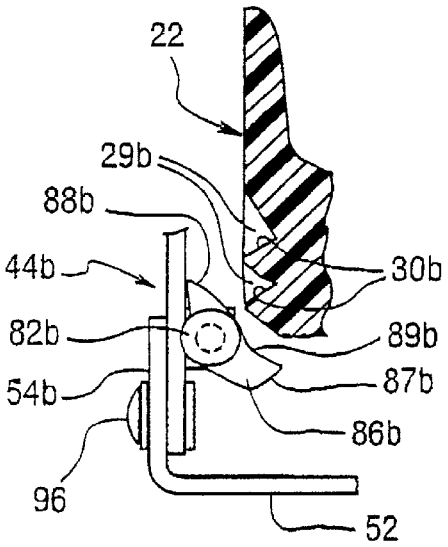
FIG. 9 is a diagrammatic, partial cross-sectional view of one of the rear binding members of the snowboard binding and the snowboard boot illustrated in FIGS. 1–8 prior to coupling the snowboard boot to the snowboard binding (i.e. with the binding member in the initial position)
Figure 10:
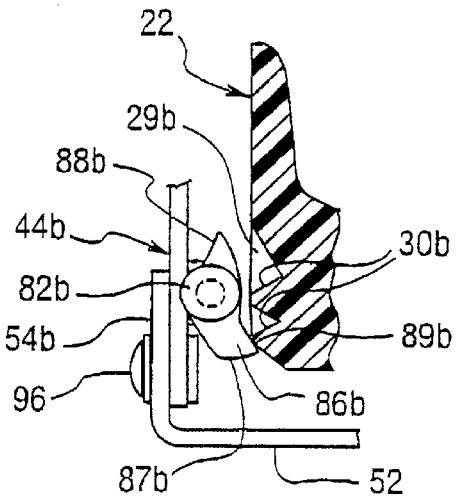
FIG. 10 is a diagrammatic, partial cross-sectional view of the rear binding member and the snowboard boot illustrated in FIG. 9 with the snowboard boot and rear binding member in an intermediate or guide position.
Figure 11:
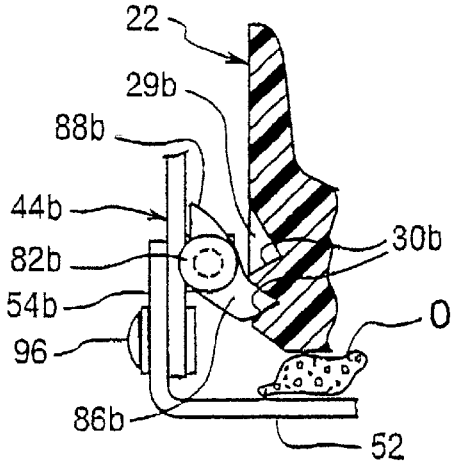
FIG. 11 is a diagrammatic, partial cross-sectional view of the rear binding member and the snowboard boot illustrated in FIGS. 9 and 10 with the snowboard boot and rear binding member in a first locked position.
Figure 12:
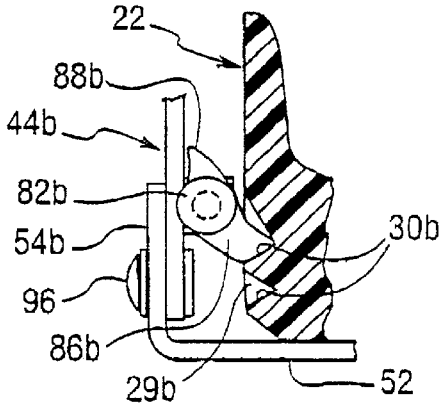
FIG. 12 is a diagrammatic, partial cross-sectional view of the rear binding member and the snowboard boot illustrated in FIGS. 9–11 with the snowboard boot and rear binding member in a second locked position.

More specifically, the stop member 88*a* includes an abutment surface configured to contact an inside surface or lateral side surface of the heel cup 48 when the binding member 44*a* is in the initial rest position. In the locked position, the latch member 86*a* is received in one of the grooves or notches 29*a* of the snowboard boot 14 and the stop surface is slightly spaced from the lateral side surface of the heel cup 48. As seen in FIGS. 11 and 12 (latch member 86*b* illustrated), the latch member 86*a* can be received in either of the lateral grooves or notches 29*a* such that the height of the snowboard boot 14 can be varied relative to the base member 40 (i.e. the mounting portion 52 of the base plate 46). The latch member 86*a* includes a locking surface 87*a* and a guide surface 89*a*, as seen in FIGS. 9, 10 (latch member 86*b* illustrated) and FIG. 14. The locking surface 87*a* engages the abutment surface 30*a* when the snowboard boot 14 in one of the locked positions.

As mentioned above, the rear binding member 44*b* is preferably a substantially mirror image of the rear binding member 44*a*. The body portion 84*b* of the binding member 44*b* is pivotally mounted on the pivot pin 82*b*. The pivot pin 82*b* is preferably a headed pivot pin with an annular groove formed at a free end thereof. A C-clip (or any other suitable retaining member) is received in the annular groove to retain the rear binding member 44*b* between a pair of flanges 92*b* and 93*b* of the heel cup 48. The biasing member 90*b* is preferably a coil spring with one end engaged with an outer later side surface of the heel cup 48 and the opposite end engaged with binding member 44*a* (i.e. a bottom surface of the latch member 86*b*) to bias the rear binding member 44*b* toward the locked position. The latch member 86*b* extends from the body portion 84*b* and is configured to engage the grooves or notches 29*b* of the snowboard boot 14. Preferably, the latch member 86*b* forms a second pawl of the (second) rear binding member 44*b*. The stop member 88*b* also extends from the body portion 84*b* but in a substantially opposite direction from the latch member 86*b*.

More specifically, the stop member 88*b* includes an abutment surface configured to contact an inside surface or lateral side surface of the heel cup 48 when the binding member 44*b* is in the initial rest position (FIG. 9). In the locked position, the latch member 86*b* is received in one of the grooves -or notches 29*b* of the snowboard boot 14 and the stop surface is slightly spaced from the lateral side surface of the heel cup 48. The latch member 86*b* can be received in either of the lateral grooves or notches 29*b* such that the height of the snowboard boot 14 can be varied relative to the base member 40 (i.e. the mounting portion 52 of the base plate 46). Latch member 86*b* includes a locking surface 87*b* and a guide surface 89*b*, as seen in FIGS. 9, 10 and 14. The locking surface 87*b* engages the abutment surface 30*b* when the snowboard boot 14 in one of the locked positions.

The heel cup 48 is preferably constructed of a hard rigid material. Examples of suitable hard rigid materials for the heel cup 48 include various metals, as well as carbon and/or a metal/carbon combination. The heel cup 48 is an arcuate member having a pair of slots 94*a* and a pair of slots 94*b* at each of the lower free ends that are attached to the side attachment sections 54*a* and 54*b*, respectively, of the base plate 46. The slots 94*a* and 94*b* receive the fasteners 96 therein to adjustably couple the heel cup 48 to the base plate 46. Additional slots 98*a* and 98*b* are provided in the heel cup 48 to attach the highback 50 to the heel cup 48 via fasteners 100. Accordingly, the heel cup 48 is adjustably coupled to the base plate 46 and the highback 50 is adjustably coupled to the heel cup 48 to form the base member 40. Thus, rear binding members 44*a* and 44*b* can be selectively coupled at different longitudinal positions relative to base member 40.

The highback 50 is a rigid member constructed of a hard rigid material. Examples of suitable hard rigid materials for the highback 50 include a hard rigid plastic material or various composite types of materials. Of course, the highback 50 could also be constructed of various metals. The highback 50 has a substantially U-shaped bottom portion with a pair of holes for receiving fasteners 100. The fasteners 100 are adjustably coupled within slots 98*a* and 98*b* of the heel cup 48 to allow adjustment of the highback 50 about a vertical axis. The highback 50 is pivotally coupled to the heel cup 48 by the fasteners 100. The connections between the highback 50, the heel cup 48 and the base plate 46 are relatively conventional. Accordingly, it will be apparent to those skilled in the art that these members could be attached in any number of ways, and that the present invention should not be limited to any particular implementation of these connections.

The highback 50 also preferably has a conventional forward lean or incline adjuster 102 that engages the heel cup 48 to cause the highback 50 to lean forward relative to the base member 40. The precise construction of the forward lean adjuster 102 is not relevant to the present invention. Moreover; the forward lean adjuster 102 is well known in the art, and thus, will not be discussed or illustrated herein. Of course, it will be apparent to those skilled in the art from this disclosure that the forward lean adjustment can be implemented in any number of ways, and that the present invention should not be limited to any particular implementation of the forward lean adjustment.

The snowboard binding system 10, in accordance with the present invention, allows for the snowboard boot 14 to be attached to the snowboard binding 12 when the highback 46 is in its forward-most lean position. Specifically, the front and rear binding members 42, and 44*a* and 44*b* are arranged such that when the rider steps into the binding 12, the snowboard boot 14 moves rearwardly against the highback 50 during the engagement process. In other words, during engagement of the front catch 26 to the binding 12, the upper portion of the snowboard boot 14 contacts the highback 50 such that the highback 50 flexes the upper portion of the snowboard boot 14 forward relative to the binding 12.

Figure 5:
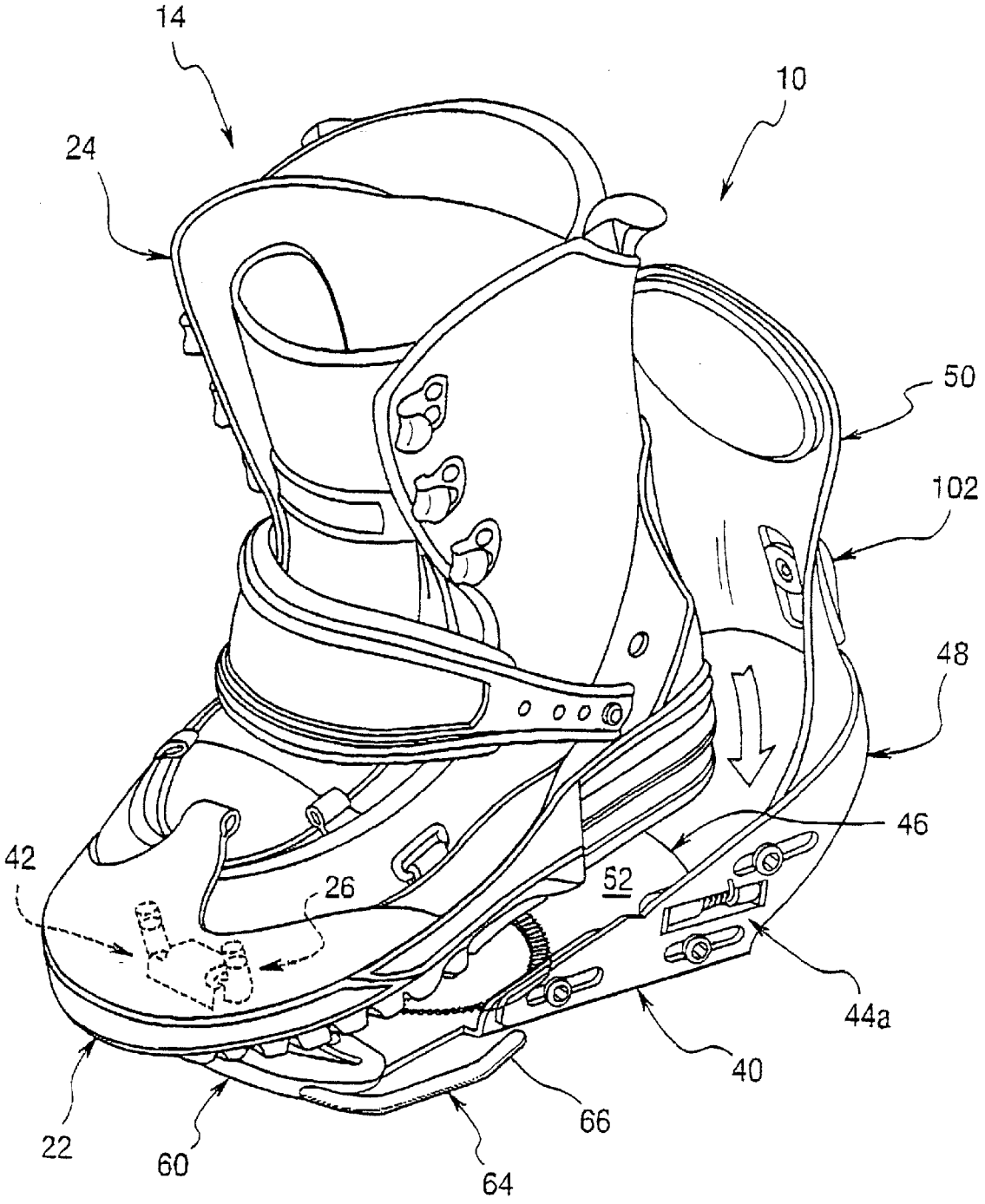
FIG. 5 is an enlarged perspective view of the snowboard binding system illustrated in FIGS. 14 showing the snowboard boot in a first position partially engaged with the snowboard binding.

Referring to FIGS. 5–8 and 9–12, mounting and dismounting the snowboard boot 14 with the snowboard binding 12 will now be discussed in more detail. When the rider wants to enter the snowboard binding 12, boot 14 should be slightly inclined as seen in FIGS. 5 and 9. The front catch 26 is first engaged with the front binding member 42. Specifically, the front catch 26 is positioned beneath the front binding flange or pawl 76. Then the rider moves the heal or rear portion of the snowboard boot 14 in a direction substantially towards the base member 40 (i.e. toward the base plate 46). In other words, the snowboard boot 14 pivots rearwardly about the front catch 26 such that the rear of the snowboard boot 14 moves substantially toward the base member 40.

Figure 6:
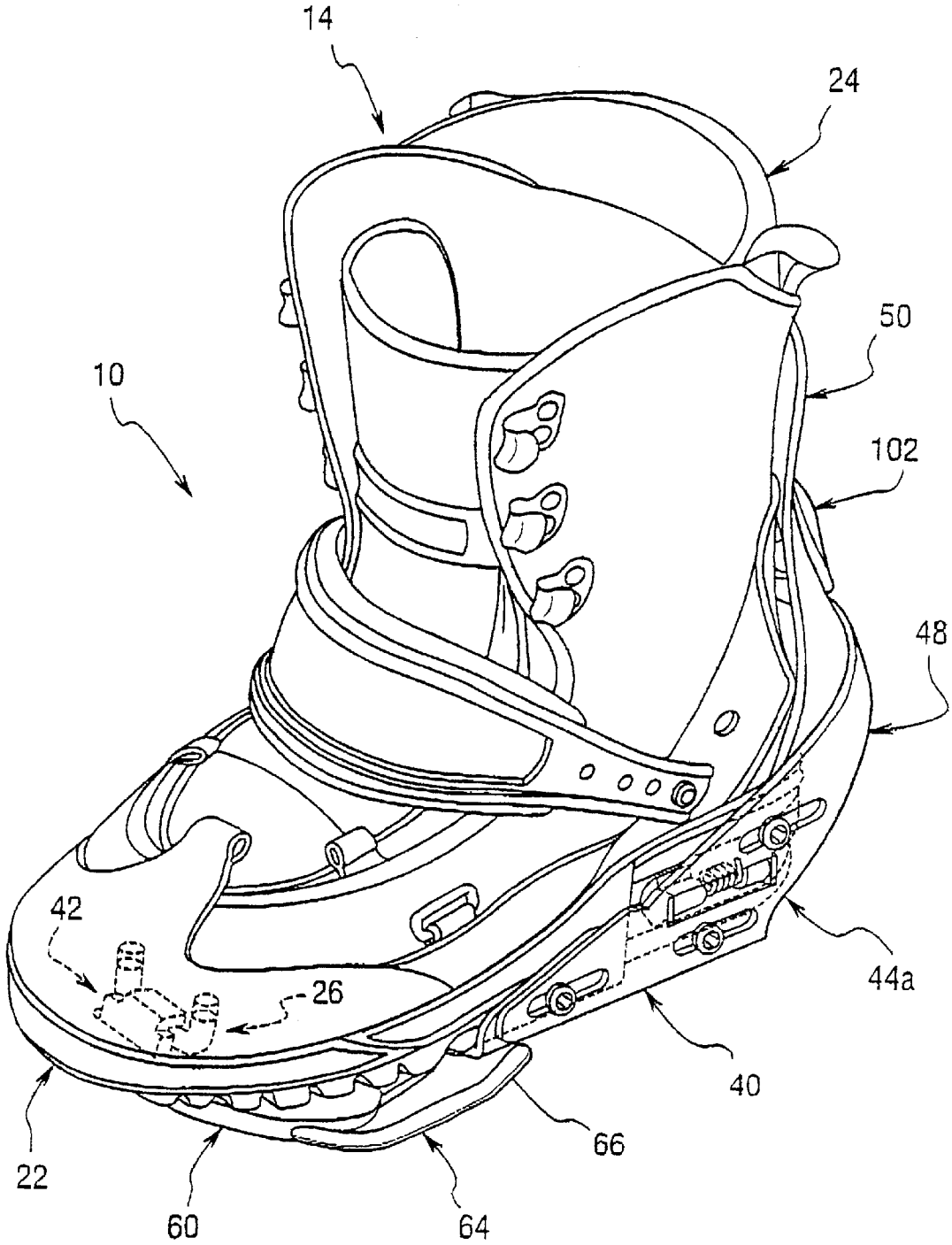
FIG. 6 is an enlarged perspective view of the snowboard binding system illustrated in FIGS. 1–5 showing the snowboard boot in a second position completely engaged with the snowboard binding.

As seen in FIG. 10, this movement of the snowboard boot 14 causes the rear binding members 44*a* and 44*b* to pivot against the biasing force of the springs 90*a* and 90*b*, respectively. Thus, the rear latch members 86*a* and 86*b* move laterally away from longitudinal axis B into guide positions (first and second guide positions, respectively) such that the snowboard boot 14 can be moved downwardly. As best seen in FIGS. 6 and 11, once the rear catches 28*a* and 28*b* move a predetermined distance, the rear latch members 86*a* and 86*b* move from the (first and second) guide positions to (first and second) locking positions. Thus snowboard boot 14 is in a first locked position. In this first locked position, the rear of the sole portion 22 is slightly spaced from the mounting portion 52 of the base plate 46. Thus an obstruction 0, such as snow, mud or sand can be accommodated if needed as seen in FIG. 11. As seen in FIG. 12, the snowboard boot 14 can be further moved into a second locked position, if no obstruction 0 prevents such movement. In this second locked position, the rear latch members 86*a* and 86*b* move from intermediate (first and second) guide positions (not shown) to additional (first and second) locking positions, respectively. Thus, the snowboard boot 14 is in a second locked position.

Figure 7:
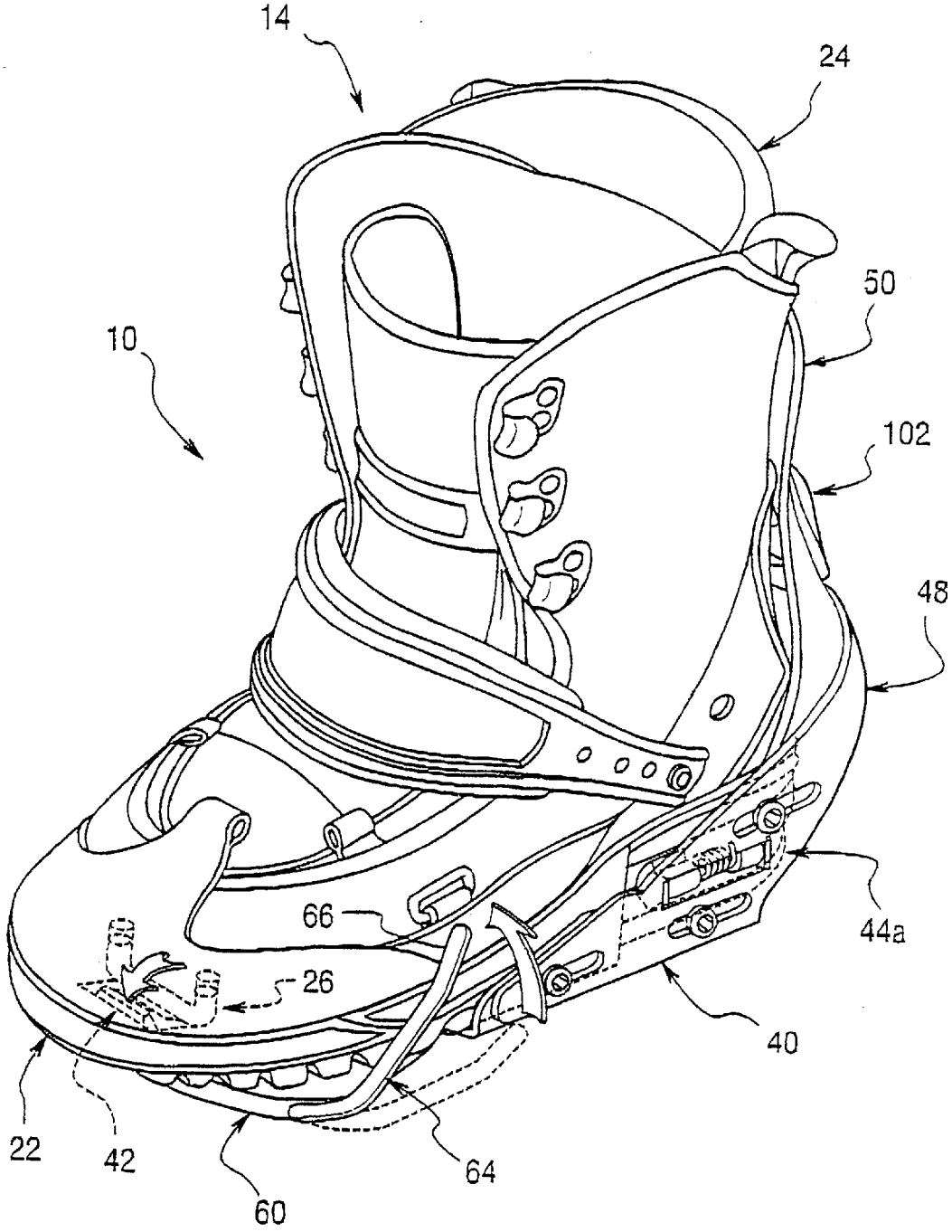
FIG. 7 is an enlarged perspective view of the snowboard binding system illustrated in FIGS. 1–6 showing the snowboard boot in the second position after moving a control lever to release the front of the snowboard boot from the snowboard binding (previous position of the control lever shown in broken lines)
Figure 8:
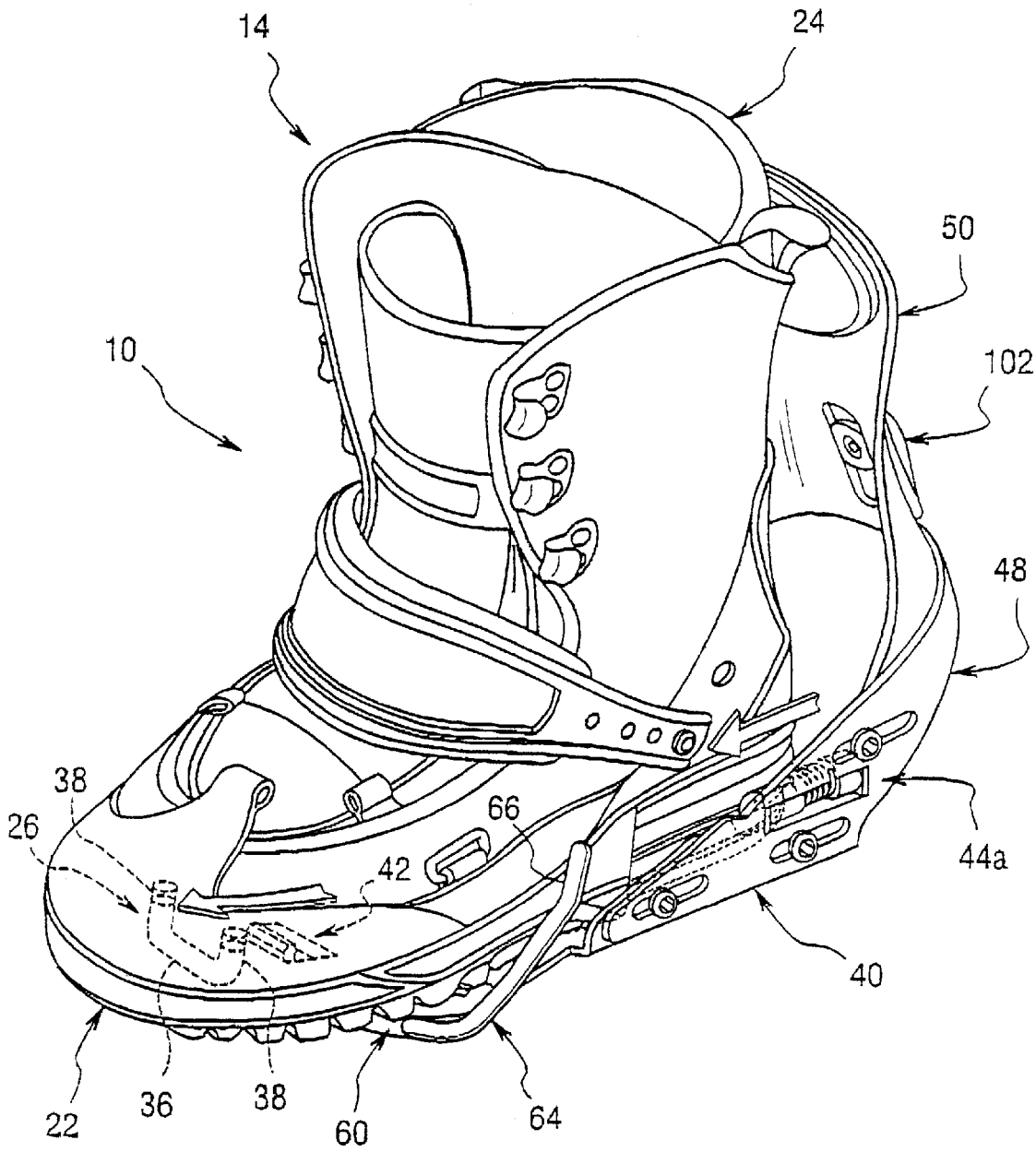
FIG. 8 is an enlarged perspective view of the snowboard binding system illustrated in FIGS. 1–7 showing the snowboard boot in a third position after moving the control lever to release the front of the snowboard boot and after sliding the snowboard boot forward (in order to completely release the snowboard boot from the snowboard binding.

Release of the snowboard boot 14 from the snowboard binding 12 will now be discussed in more detail. The snowboard binding 12 can easily release the snowboard boot 14 therefrom, when the snowboard boot 14 is in either of the locked positions (FIGS. 6, 11 and 12). Specifically, as seen in FIG. 7, the release lever 64 is pivoted in order to move the front binding member 42 from the latched position (FIG. 6) to the release position. Thus, the front catch 26 of the snowboard boot 14 is released from the snowboard binding 12. However, the rear binding members 44*a* and 44*b* remain in the engagement or locking positions. In order to completely, detach the snowboard boot 14 from snowboard binding 12, the snowboard boot 14 is then moved longitudinally (i.e. along longitudinal axis B) such that the rear pawls 86*a* and 86*b* slide in the notches 29*a* and 29*b*, respectively. After the boot 14 is moved a sufficient distance, the rear pawls 86*a* and 86*b* will not engage or lock notches 29*a* and 29*b*. Thus the snowboard boot 14 can be completely released from snowboard binding 12.

Second Embodiment

Figure 18:
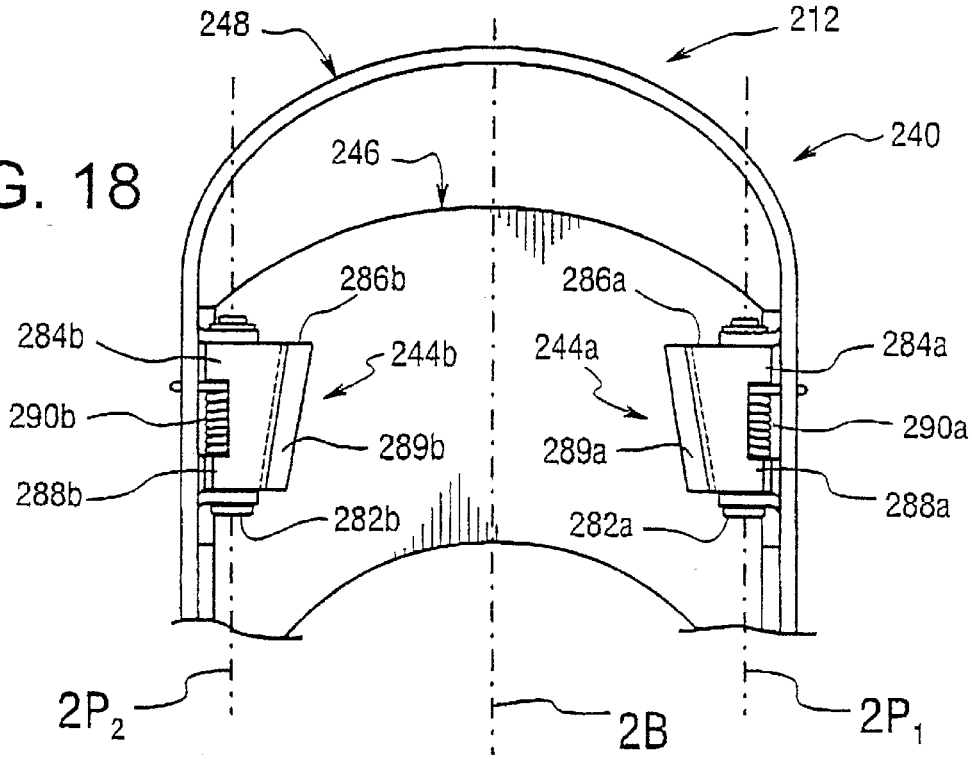
FIG. 18 is a diagrammatic, top plan view of a portion of a snowboard binding in accordance with a second embodiment of the present invention.

Referring now to FIG. 18, a portion of a snowboard binding 212 is illustrated in accordance with a second embodiment of the present invention. The snowboard binding 212 of this second embodiment is identical to the snowboard binding 12 of the first embodiment, except that the snowboard binding 212 has a pair (first and second) of rear binding members 244*a* and 244*b* that are modified versions of the rear binding members 44*a* and 44*b* of the first embodiment. The snowboard binding 212 is designed to be used with a snowboard boot identical or substantially identical to the snowboard boot 14 of the first embodiment. Since the snowboard binding 212 of the second embodiment is substantially identical to the snowboard binding 12 of the first embodiment, the snowboard binding 212 will not be discussed or illustrated in detail herein. Rather, the following description will focus mainly on the differences. Moreover, it will be apparent to those skilled in the art that most of the descriptions of the snowboard binding system 10, the snowboard binding 12 and the snowboard boot 14 of the first embodiment apply to the snowboard binding 212 of this second embodiment.

The snowboard binding 212 basically includes a base member 240, a front binding member (not shown) and the pair (first and second) of rear binding members 244*a* and 244*b*. The base member 240 of this second embodiment basically includes a base plate 246, a heel cup 248 and a highback (not shown). The base member 240 is identical to the base member 40 of the first embodiment. Thus, the base member 240 will not be discussed or illustrated in detail herein. Moreover, the front binding member (not shown) of the snowboard binding 212 is identical to the front binding member 42 of the first embodiment. Accordingly, the front binding member of this second embodiment will not be discussed or illustrated in detail herein. As mentioned above, the rear binding members 244*a* and 244*b* are modified versions of the rear binding members 44*a* and 44*b* of the first embodiment. More specifically, the rear binding member 44*a* basically includes a (first) pivot pin 282*a*, a (first) body portion 284*a*, a (first) latch member 286*a*, a (first) stop member 288*a* and a (first) biasing member 290*a*. The rear binding member 244*b* basically includes a (second) pivot pin 282*b*, a (second) body portion 284*b*, a (second) latch member 286*b*, a (second) stop member 288*b* and a (second) biasing member 290*b*. Rear binding members 244*a* and 244*b* are pivotally coupled to the base member 240 about a pair (first and second) pivot axes $2P_1$ and $2P_2$ in a manner identical to the first embodiment. In other words, the body portion 284*a* is pivotally mounted on the pivot pin 282*a*, while the body portion 284*b* is pivotally mounted on the pivot pin 282*b*. On the other hand, the latch members 286*a* and 286*b* are slightly modified versions of the latch members 86*a* and 86*b* of the first embodiment. Specifically, the latch member 286*a* includes a locking surface (not shown) and a guide surface 289*a*, while the latch member 286*b* includes a locking surface (not shown) and a guide surface 289*b*. The latch members 286*a* and 286*b* (i.e. the lock surfaces and the guide surfaces 289*a* and 289*b*) are identical to the latch members 86*a* and 86*b*, except the latch members 286*a* and 286*b* are angled relative to a center longitudinal axis 2B of the base member 240. In other words, (first and second) elongated locking surfaces (not shown) diverge relative to longitudinal axis 2B of the base member 240 as the elongated locking surfaces extend from the rear portion of the base member 240 towards the front portion (not shown). Moreover, the latch members 286*a* and 286*b* are angled relative to the pivot axes $2P_1$ and $2P_2$. In other words, the snowboard binding 212 is designed to be used with a snowboard boot with angled notches that correspond in shape to the latch members 286*a* and 286*b*.

Third Embodiment

Figure 19:
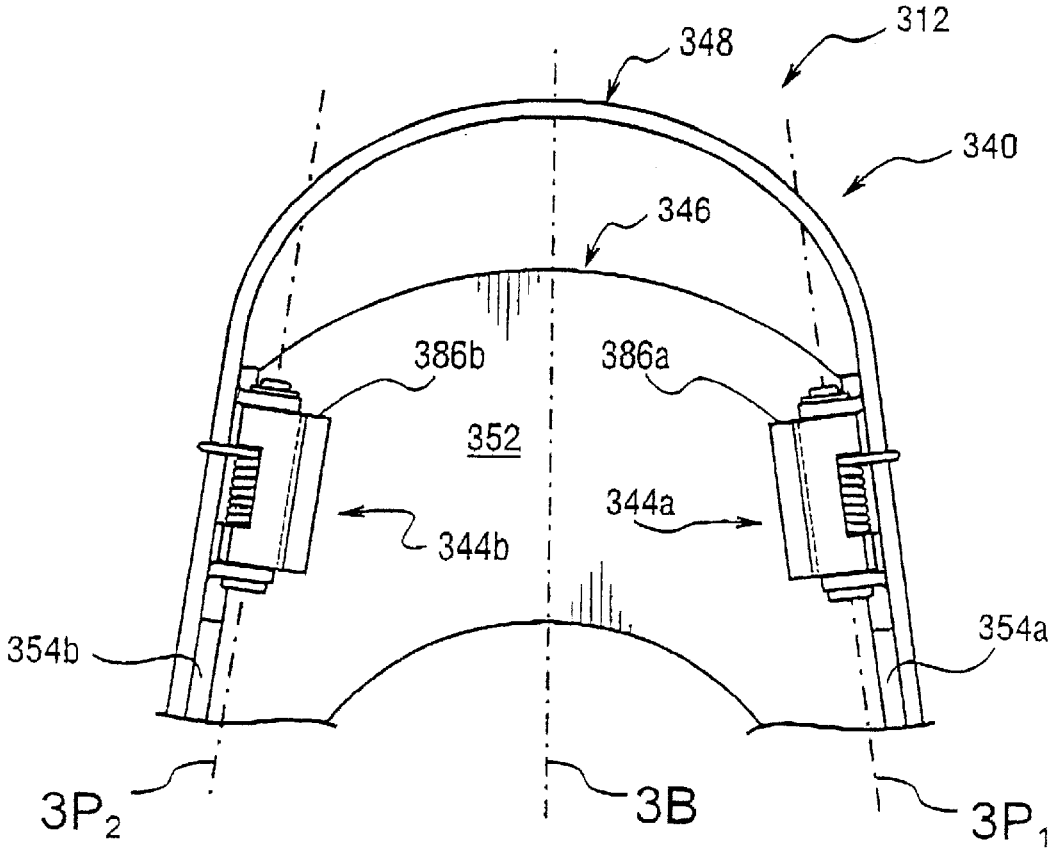
FIG. 19 is a diagrammatic, top plan view of a portion of a snowboard binding in accordance with a third embodiment of the present invention.

Referring now to FIG. 19, a snowboard binding 312 is illustrated in accordance with a third embodiment of the present invention. The snowboard binding 312 of this third embodiment is substantially identical to the snowboard binding 12 of the first embodiment except the snowboard binding 312 utilizes a base member 340 which is a modified version of the base member 40 of the first embodiment. The snowboard binding 312 is designed to be used with a snowboard boot identical or substantially identical to the snowboard boot 14 of the first embodiment. Since the snowboard binding 312 of this third embodiment is substantially identical to snowboard binding 12 of the first embodiment, the snowboard binding 312 will not be discussed or illustrated in detail herein. Rather, the following description will focus mainly on the differences. Moreover, it will be apparent to those skilled in the art that most of the descriptions of snowboard binding system 10, the snowboard binding 12 and the snowboard boot 14 of the first embodiment apply to the snowboard binding 312 of this third embodiment.

The snowboard binding 312 basically includes the modified base member 340, a front binding member (not shown) and a pair (first and second) of rear binding members 344*a* and 344*b*. The front binding member (not shown) of the snowboard binding 312 is identical to the front binding member 42 of the first embodiment. Moreover, the rear binding members 344*a* and 344*b* are identical to the rear binding members 44*a* and 44*b* of the first embodiment. Thus, the front binding member (not shown) and the rear binding members 344*a* and 344*b* will not be discussed or illustrated in detail herein. The modified base member 340 is identical to the base member 40 of the first embodiment except that the shape has been slightly modified such that the rear binding members 344*a* and 344*b* are slightly angled relative to a center longitudinal axis 3B of the base member 340. The base member 340 basically includes a base plate 346, a heel cup 348 and a highback (not shown). The base plate 346 includes a mounting portion 352 and a pair (first and second) of side attachment sections 354*a* and 354*b*. The base plate 346 is identical to the base plate 46 of the first embodiment except that the attachment sections 354*a* and 354*b* are slightly angled relative to center longitudinal axis 3B. Moreover, heel cup 348 is identical to the heel cup 48 of the first embodiment, except that the shape of the heel cup 348 has been modified to be used with the modified base plate 346. In other words, the free ends of the heel cup 348 are also preferably slightly angled relative to the center longitudinal axis 3B. Moreover, the highback (not shown) of the snowboard binding 312 may be slightly modified in order to be utilized with the base plate 346 and the heel cup 348. However, the highback is preferably formed of a material, which has limited flexibility such that the highback 50 of the first embodiment could also be used with the base plate 346 and the heel cup 348. Due to the configurations of the base plate 346 and heel cup 348, the rear binding members 344*a* and 344*b* are angled relative to center axis 3B. More specifically, the rear binding members 344*a* and 344*b* are pivotally coupled to the base member 340 about a pair (first and second) of the pivot axes $3P_1$ and $3P_2$, respectively. The pivot axes $3P_1$, and $3P_2$ are angled (i.e. diverge from axis 3B toward the front portion of the base member 340) relative to the longitudinal axis 3B. Moreover, the rear binding member 344*a* has a latch member 386*a* while rear binding member 344*b* has a latch member 386*b*. Thus, the latch members 386*a* and 386*b* are angled relative to center longitudinal axis 3B. In other words, the rear binding members 344*a* and 344*b* are identical to the rear binding members 44*a* and 44*b* of the first embodiment, except that the orientation of the rear binding member 344*a* and the orientation of the rear binding member 344*b* have been modified due to the configuration of the base member 340. In other words, (first and second) elongated locking surfaces (not shown) diverge relative to the longitudinal axis 3B of the base member 340 as the elongated locking surfaces extend from the rear portion of the base member 340 towards the front portion (not shown). Thus, the snowboard binding 312 is designed to be used with a snowboard boot with angled notches that correspond in shape to latch members 386*a* and 386*b*.

Fourth Embodiment

Figure 20:
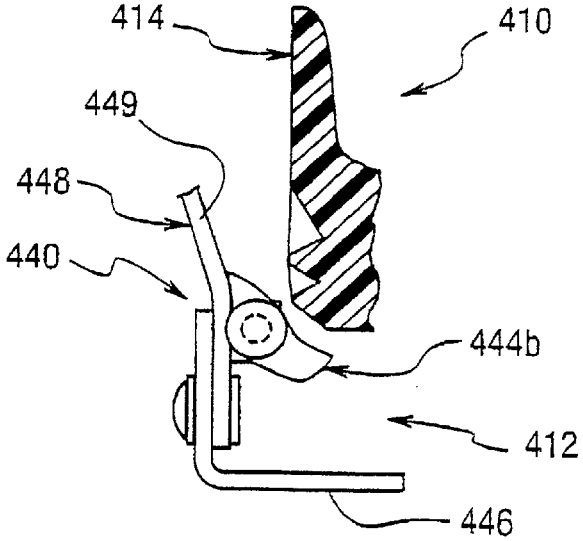
FIG. 20 is a diagrammatic, partial cross-sectional view of a portion of a snowboard binding system in accordance with a fourth embodiment of the present invention.

Referring now to FIG. 20, a portion of a snowboard binding system 410 is illustrated in accordance with a fourth embodiment of the present invention. The snowboard binding system 410 of this fourth embodiment is substantially identical to the snowboard binding system 10 of the first embodiment, except the snowboard binding system 410 includes a base member 440, which is a modified version of the base member 40 of the first embodiment. The snowboard binding system 410 has a snowboard binding 412, which is designed to be used with a snowboard boot identical or substantially identical to snowboard boot 14 of the first embodiment. Since the snowboard binding system 410 is substantially identical to snowboard binding system 10 of the first embodiment, the snowboard binding system 410 will not be discussed or illustrated in detail herein. Rather, the following description will focus mainly on the differences. Moreover, it will be apparent to those skilled in the art that most of the descriptions of snowboard binding system 10 of the first embodiment also apply to the snowboard binding system 410 of this fourth embodiment.

The snowboard binding system 410 basically includes the snowboard binding 412 and a snowboard boot 414. The snowboard boot 414 is identical to the snowboard boot 14 of the first embodiment. Thus, the snowboard boot 414 will not be discussed or illustrated in detail herein. The snowboard binding 412 basically includes a base member 440, a front binding member (not shown) and a pair (first and second) of rear binding members (only one shown). The front binding member (not shown) of the snowboard binding 412 is identical to the front binding member 42 of the first embodiment. Moreover, the rear binding members (only one rear binding member 444*b* shown) are also identical to the rear binding members 44*a* and 44*b* of the first embodiment. On the other hand, the base member 440 is a modified version of the base member 40 of the first embodiment. More specifically, the base member 440 includes a base plate 446, a heel cup 448 and a highback (not shown). The base plate 446 and the highback (not shown) of the base member 440 are identical to the base plate 46 and the highback 50 of the first embodiment. However, the heel cup 448 is a modified version of the heel cup 48 of the first embodiment. Specifically, the heel cup 448 has a pair of flared sections or support members (only one shown) 449 formed at the free ends of the heel cup 448 to aid in guiding the snowboard boot 414 into the snowboard binding 412. The support members 449 are slanted upwardly and outwardly from the base plate 446. The support members 449 can be slightly curved if needed and/or desired.

Fifth Embodiment

Referring now to FIGS. 21–45, a modified snowboard binding 512 and a modified snowboard boot 514 are illustrated in accordance with a fifth embodiment of the present invention. The snowboard binding 512 of this fifth embodiment is identical to the snowboard binding 12 of the first embodiment, except that the front binding arrangement of the snowboard binding 512 has been modified from the front binding arrangement of the snowboard binding 12 of the first embodiment as discussed below. Thus, the remaining parts of the snowboard binding 512 are identical to the snowboard binding 12 of the first embodiment. Since the snowboard binding 512 of the fifth embodiment is substantially identical to the snowboard binding 12 of the first embodiment, the snowboard binding 512 will not be discussed or illustrated in detail herein. Rather, the following description will focus mainly on the differences of the snowboard binding 512 from the snowboard binding 12. Moreover, it will be apparent to those skilled in the art that most of the descriptions of the snowboard binding system 10, the snowboard binding 12 and the snowboard boot 14 of the first embodiment apply to the snowboard binding 512 of this fifth embodiment.

Figure 21:
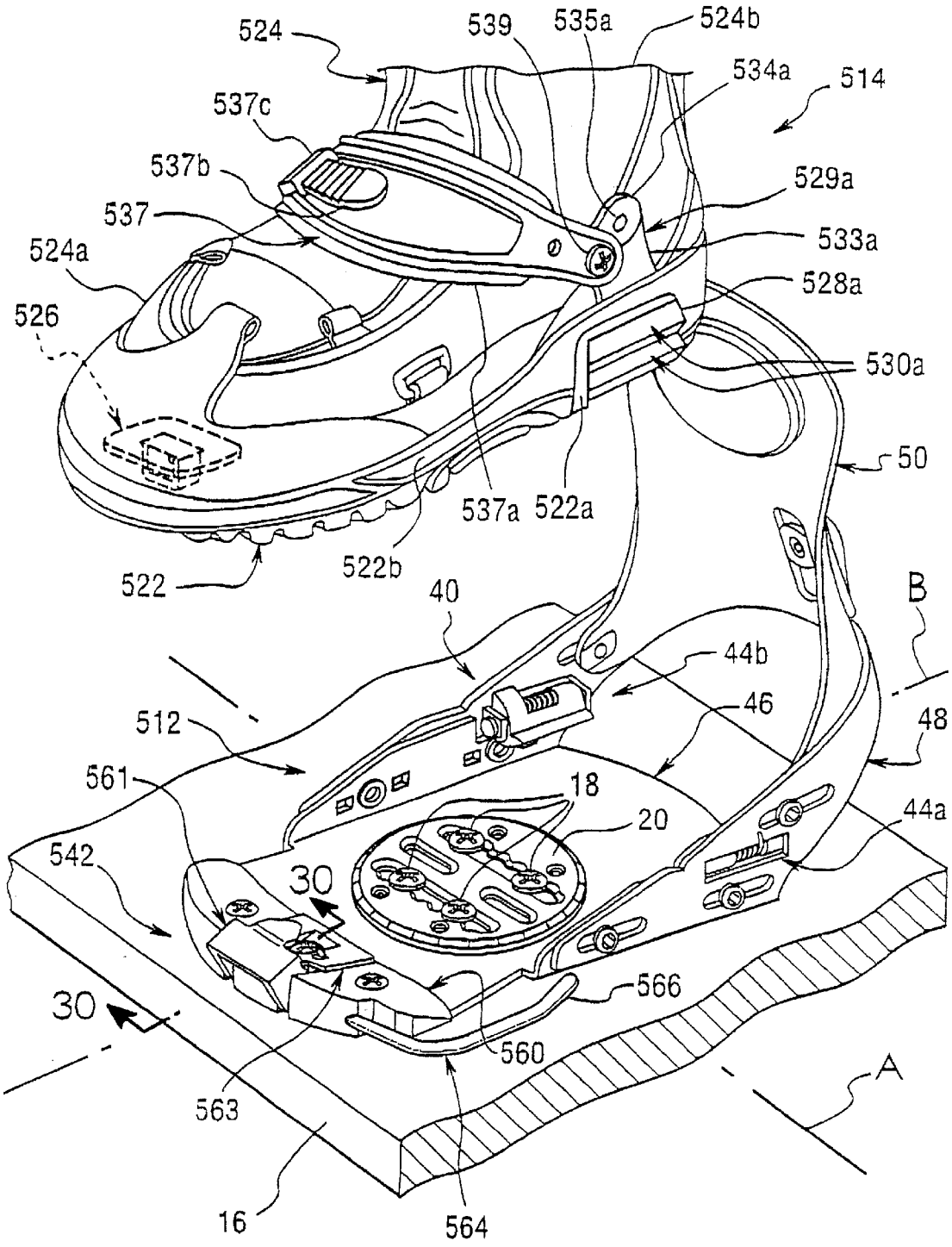
FIG. 21 is a perspective view of a snowboard binding system having a snowboard binding fixed to a snowboard and a snowboard boot in accordance with a fifth embodiment of the present invention.

Referring now to FIGS. 21 and 31–45, the snowboard boot 514 of the present invention will be discussed in more detail. As seen in FIG. 21, the snowboard boot 514 is designed to be utilized with the snowboard binding 512. The snowboard boot 514 of the present invention basically has a sole portion 522 and an upper portion 524. The upper portion 524 has a foot section 524*a* fixedly coupled to the sole portion 522 and a leg portion 524*b* extending upwardly from the foot section 524*a*. The upper portion 524 is basically constructed of a flexible material and is fixedly attached to the sole portion 522 via adhesive molding and/or stitching (not shown). The upper portion 524 is not critical to the present invention, and thus, will not be discussed and/or illustrated in detail herein.

Figure 34:
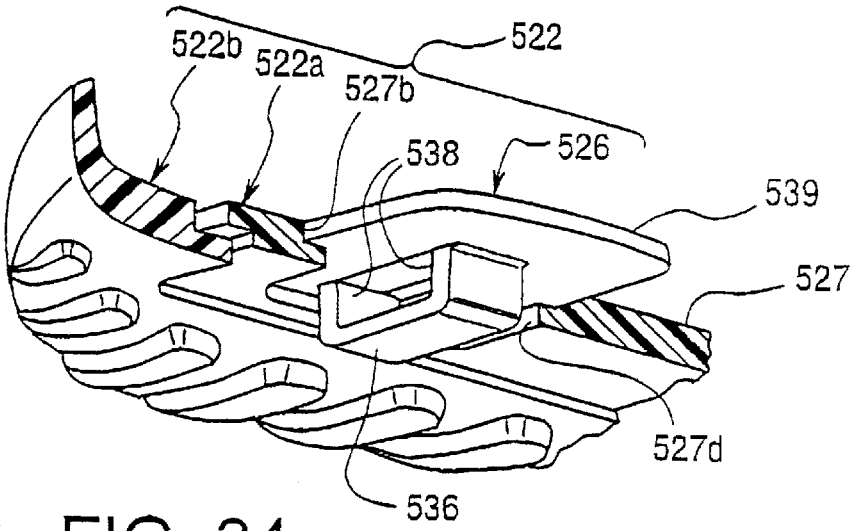
FIG. 34 is a partial bottom perspective view of the sole portion with the front catch of the snowboard boot illustrated in FIG. 21.
Figure 35:
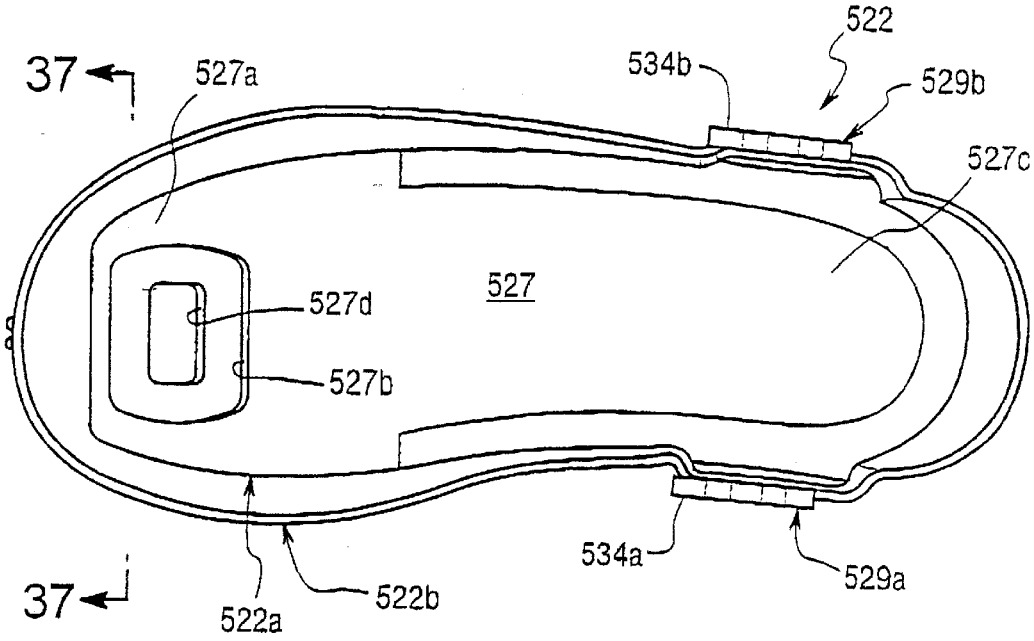
FIG. 35 is a center longitudinal cross sectional view of the sole portion of the snowboard boot illustrated in FIG. 21 with the front catch removed.
Figure 36:
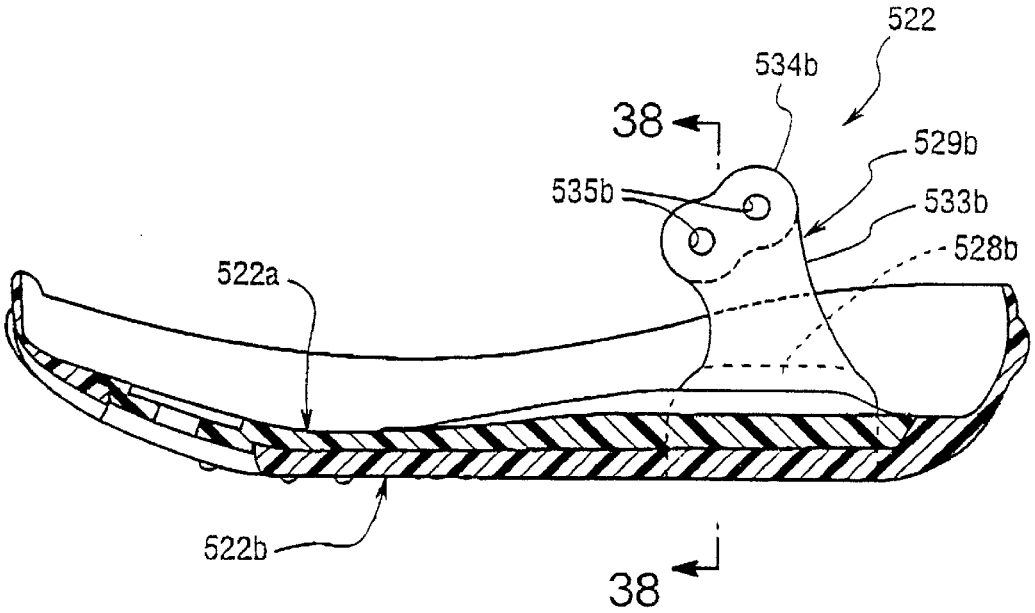
FIG. 36 is atop plan view of the sole portion of the snowboard boot illustrated in FIG. 21 with the front catch removed.
Figure 37:
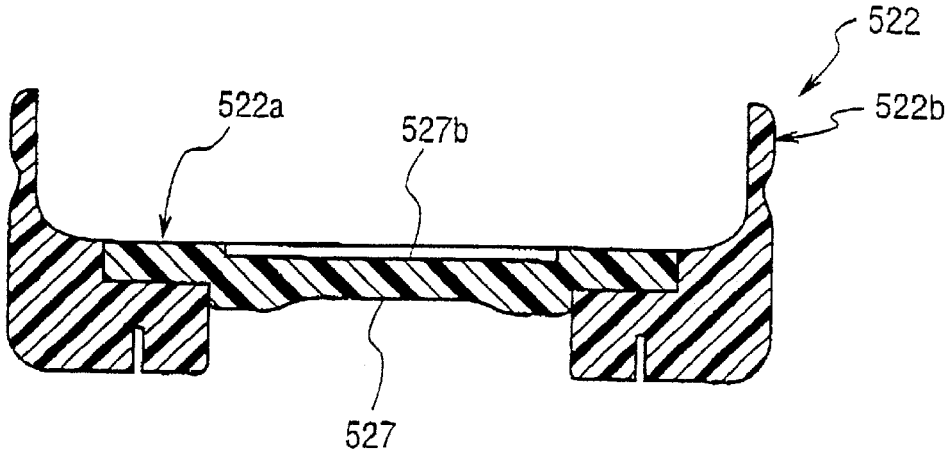
FIG. 37 is a transverse cross sectional view of the sole portion of the snowboard boot illustrated in FIG. 21 with the front catch removed as seen along section line 37—37 of FIG. 36.
Figure 38:
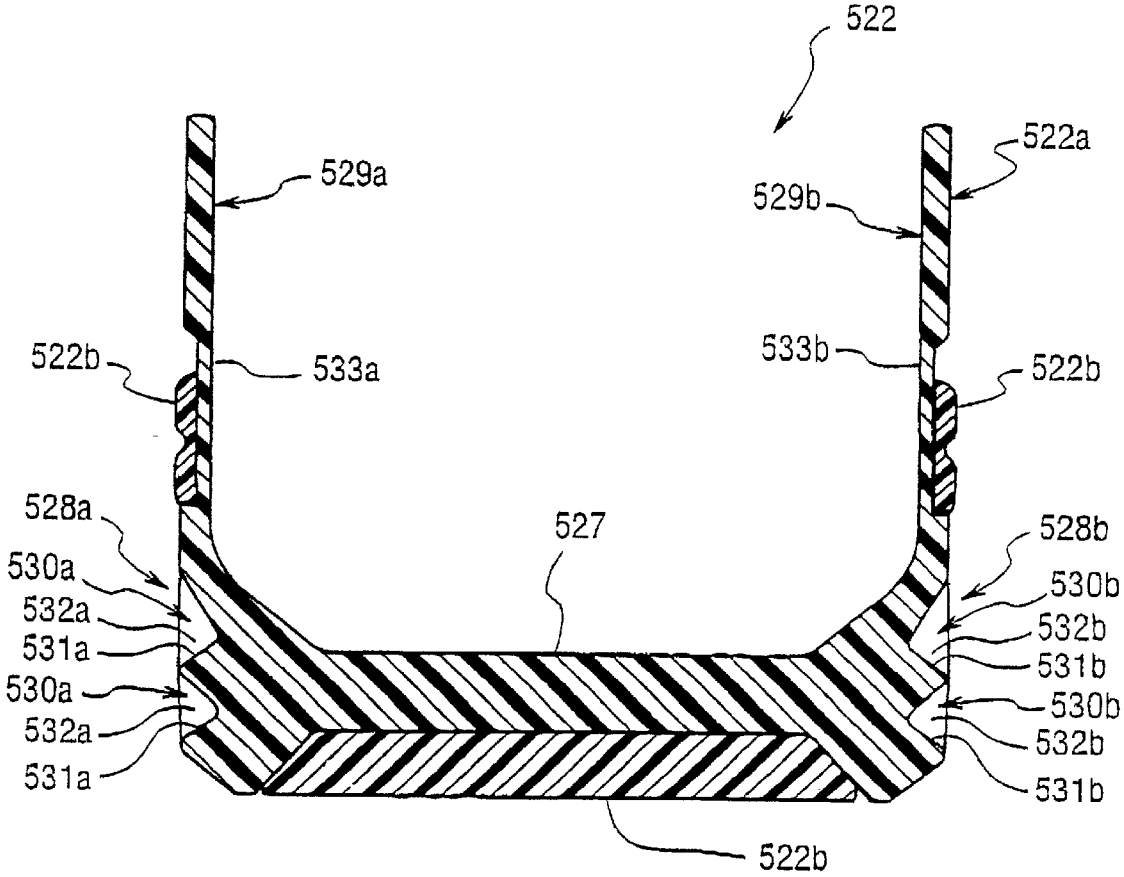
FIG. 38 is a transverse cross sectional view of the sole portion of the snowboard boot illustrated in FIG. 21 as seen along section line 38—38 of FIG. 35.
Figure 39:
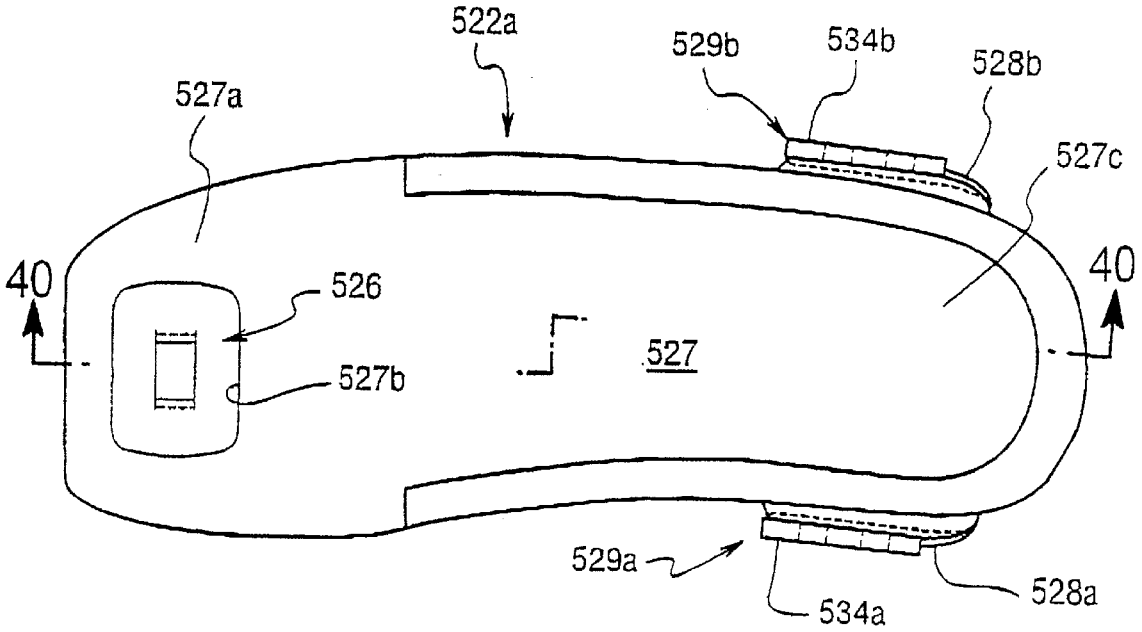
FIG. 39 is a top plan view of the mid sole of the sole portion of the snowboard boot illustrated in FIG. 21.
Figure 40:
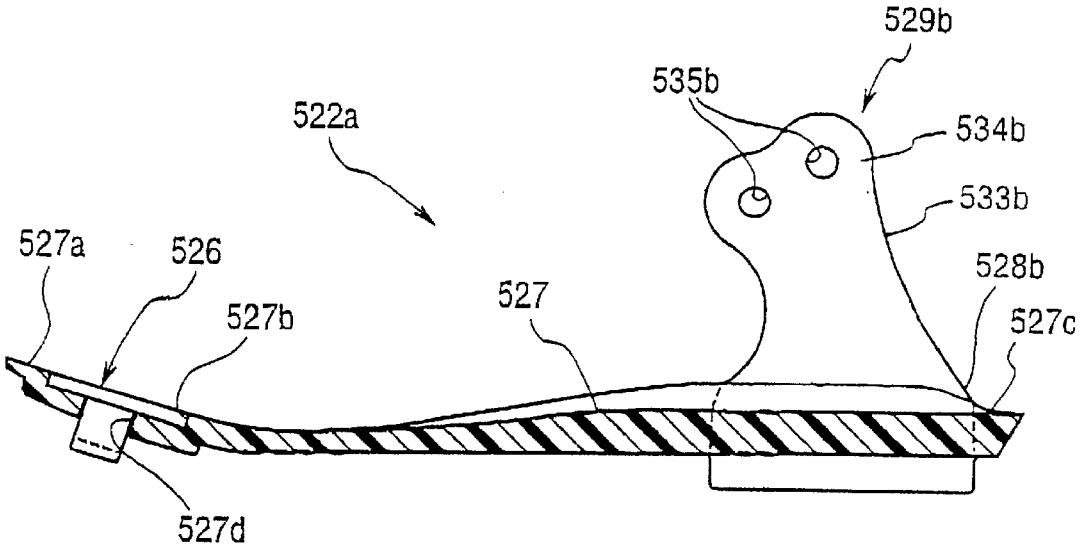
FIG. 40 is a center longitudinal cross sectional view of the mid sole of the sole portion illustrated in FIG. 39 as seen along section line 40—40 of FIG. 39.
Figure 41:
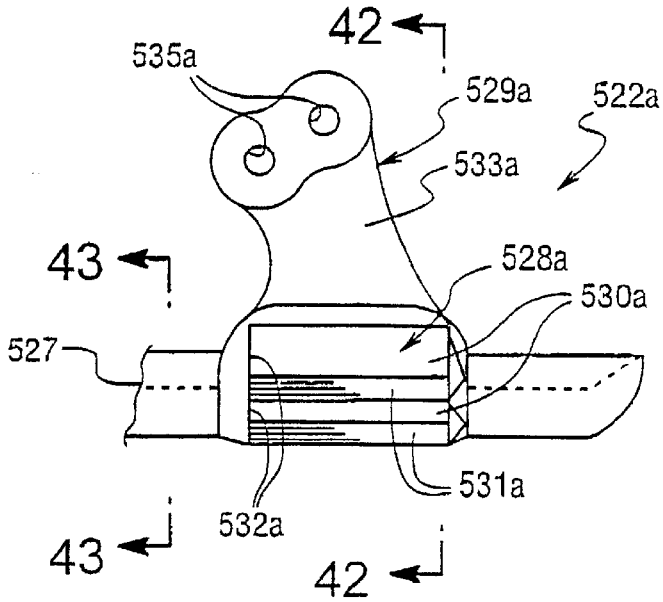
FIG. 41 is a partial side elevational view of the mid sole of the sole portion illustrated in FIGS. 39 and 40.
Figure 42:
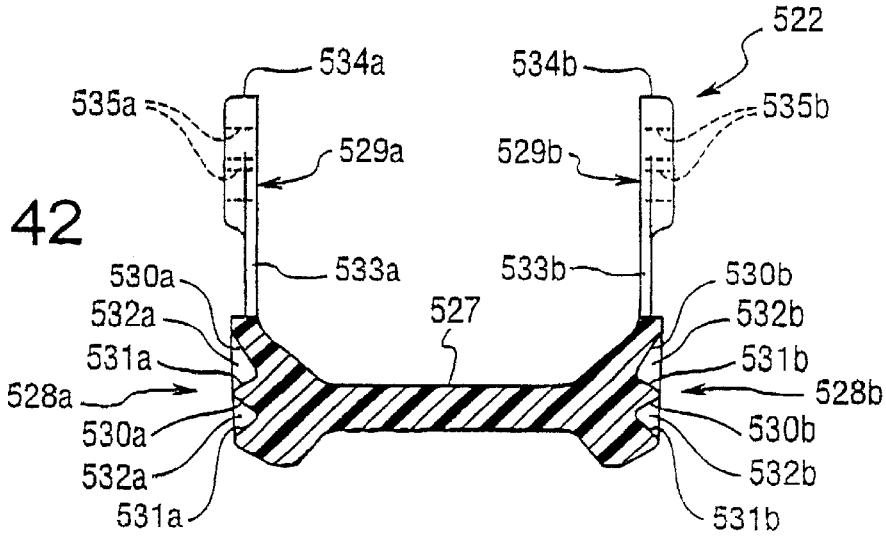
FIG. 42 is a transverse cross sectional view of the mid sole of the sole portion illustrated in FIGS. 39–41 as seen along section line 42—42 of FIG. 41.
Figure 43:
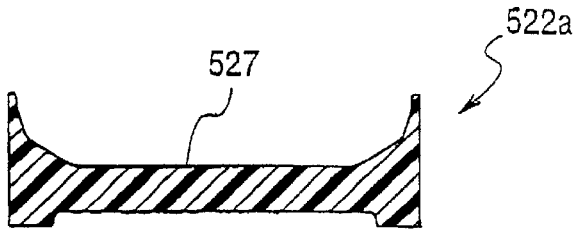
FIG. 43 is a transverse cross sectional view of the mid of the sole portion illustrated in FIG. 39 as seen along section line 43—43 of FIG. 41.
Figure 44:
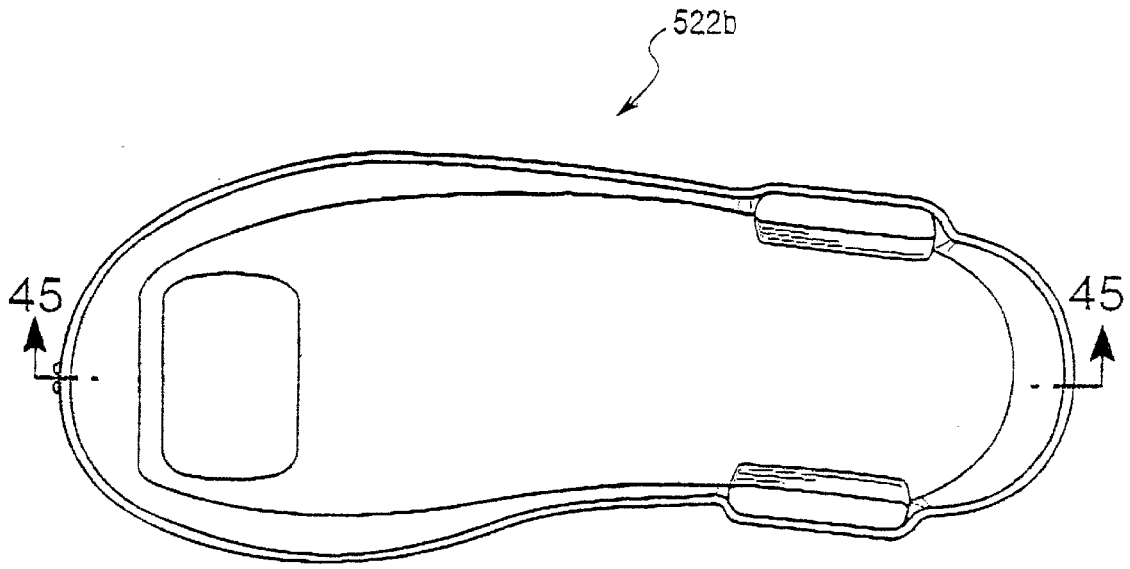
FIG. 44 is a top plan view of the outer sole of the sole portion of the snowboard boot illustrated in FIG. 21.
Figure 45:
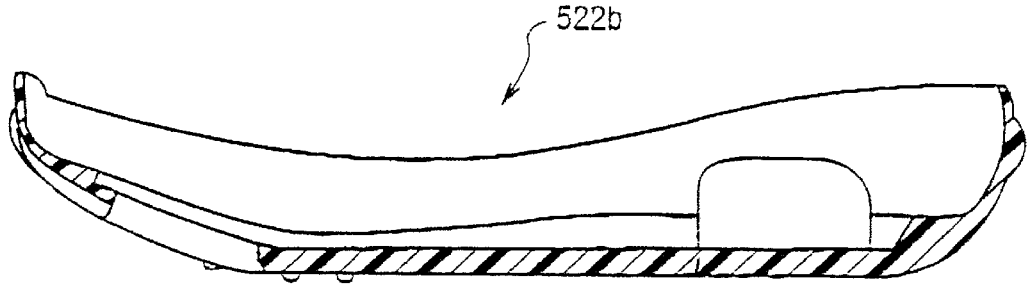
FIG. 45 is a center longitudinal cross sectional view of the outer sole of the sole portion illustrated in FIG. 44 as seen along section line 45—45 of FIG. 44.

As seen in FIGS. 34–45, the sole portion 522 is basically constructed of three parts. More specifically, the sole portion 522 has a mid sole 522*a* with an outer sole 522*b* molded thereon as seen in FIGS. 34–38 and a front catch 526 located at a front part of the mid sole 522*a* as seen in FIGS. 34, 39 and 40. The outer sole 522*b* is also molded onto the lower peripheral edge of the upper portion 524 such that the outer sole 522*b* fixedly and securely attaches the upper portion 524 to the mid sole 522*a*. The outer sole 522*b* is preferably constructed of a resilient rubber material that is suitable for forming the tread of the snowboard boot 514. As mentioned above, stitching can also be utilized to more securely fasten the upper portion 524 to the outer sole 522*b*.

As best seen in FIGS. 39–43, the mid sole 522*a* basically has a base portion 527, a pair (first and second) of rear catches 528*a* and 528*b*, and a pair (first and second) of strap attachment members 529*a* and 529*b*. In the most preferred embodiment, the first and second rear catches 528*a* and 528*b* and the first and second strap attachment members 529*a* and 529*b* are integrally formed with the base portion 527 of the mid sole 522*a* as a one-piece, unitary member. In other words, the mid sole 522*a* is preferably molded as a one-piece, unitary member with the first and second rear catches 528*a* and 528*b* and the first and second strap attachment members 529*a* and 529*b* being formed of a homogeneous material. The mid sole 522*a* is preferably constructed of a flexible but somewhat rigid material. For example, one suitable material for the mid sole 522*a* is a polyamide (PA) rubber with 35% glass fiber dispersed therein.

The base portion 527 of the mid sole 522 has a front toe section 527*a* with a front catch receiving recess 527*b* and a rear heel section 527*c*. Accordingly, the front catch 526 is located in the front catch receiving recess 527*b* of the base portion 527, while the front and rear catches 528*a* and 528*b* are located at the first and second lateral sides of the heel section 527*c* of the base portion 527. Similarly, the first and second strap attachment members 529*a* and 529*b* extend upwardly from the heel section 527*c* of the base portion 527. More preferably, the first and second strap attachment members 529*a* and 529*b* extend upwardly from the upper edges of the portions forming the first and second rear catches 528*a* and 528*b*.

The front catch 526 is preferably either molded into the mid sole 522*a* or attached thereto via fasteners (not shown). Alternatively, the front catch 526 can merely rest within the front catch receiving recess 527*b* and be held in place by an inner sole or liner and the wearer's foot.

Figure 33:
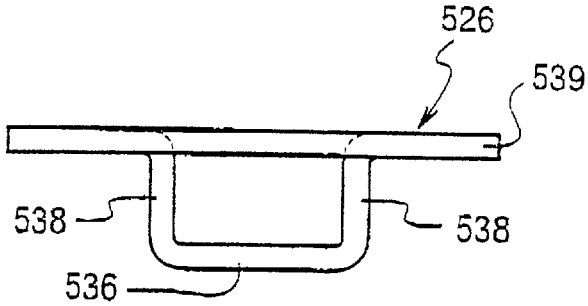
FIG. 33 is a front elevational view of the front catch illustrated in FIGS. 31 and 32 for the snowboard boot illustrated in FIG. 21.

As seen in FIGS. 31–34, the front catch 526 is basically a U-shaped member with a bight portion 536 and a pair of leg portions 538 extending upwardly from the bight portion 536. The leg portions 538 are coupled together by a mounting plate 539. The mounting plate 539 rests on the upwardly facing surface of the front catch receiving recess 527*b*, while the bight portion 536 and the leg portions 538 extend through the opening 527*d* formed in the front catch receiving recess 527*b*. Preferably, the front catch 526 is constructed of a one-piece, unitary member with the bight portion 536 and the leg portions 538 having a rectangular cross section as best seen in FIGS. 33 and 34. In the most preferred embodiment, the front catch 526 is preferably constructed of a hard rigid material, such as steel or any other suitable material. It will be apparent to those skilled in the art from this disclosure that the front catch 526 can be implemented in any number of ways, and the present invention is not limited to the particular implementations shown in the drawings, which are provided for merely purposes of illustration. Of course, it will be apparent to those skilled in the art that the construction of the front catch 526 will depend upon the particular binding being utilized.

As mentioned above and as seen best in FIGS. 38, 41 and 42, the rear catches 528*a* and 528*b* are molded with the mid sole 522*a* of the sole portion 522. The rear catches 528*a* and 528*b* are designed to engage the snowboard boot binding 512 at a plurality of engagement or locking positions having different heights relative to the snowboard binding 512. More specifically, the first rear catch 528*a* is formed by molding a plurality (only two illustrated) of V-shaped grooves or notches 530*a* into a first lateral side of the mid sole 522*a* of the sole portion 522. Likewise, the second rear catch 528*b* is formed by molding a plurality (only two illustrated) of V-shaped grooves 530*b* into a second opposite lateral side of the mid sole 522 of the sole portion 522. Preferably, each of the notches 530*a* has an abutment surface 531*a* that is angled relative to the bottom surface of the base portion 527. Likewise, the notches 530*b* have abutments surfaces 531*b* that is angled relative to the bottom surface of the base portion 527. Preferably, each of the abutment surfaces 531*a* or 531*b* forms an angle of about 30° with the bottom surface of the base portion 527. In other words, the abutment surfaces 531*a* and 531*b* taper downwardly from a center plane of the snowboard boot 514 and are configured to engage the snowboard binding 512 to prevent upward movement of the snowboard boot 514 relative to the snowboard boot binding 512. The notches 530*a* and 530*b* also preferably have a depth sufficient to prevent upward movement of the snowboard boot 514 relative to the snowboard boot binding 512 and are configured/shaped to mate with the snowboard boot binding 512 as discussed below.

At the front edge of each of the V-shaped grooves or notches 530*a* and 530*b* are stop surfaces 532*a* and 532*b* which limit rearward movement of the snowboard boot relative to the snowboard boot binding 512.

Of course, it will be apparent to those skilled in the art from this disclosure that the snowboard boot 514 can be designed to have additional engagement or locking positions at different heights, if needed and/or desired. For example, the snowboard boot 514 can be designed to have three different engagement positions with three different heights (i.e., three V-shaped grooves), respectively. However, it should be appreciated from this disclosure that the present invention is not limited to the precise construction of the rear catches 528*a* and 528*b*. Rather, the rear catches 528*a* and 528*b* can be implemented in a number of ways, and the present invention is not limited to the particular implementations shown in the drawings, which are provided merely for purposes of illustration.

The first and second strap attachment members 529*a* and 529*b* include first and second flexible connecting portions 533*a* and 533*b* and first and second attachment portions 534*a* and 534*b* located at free ends of the first and second flexible connecting portions 533*a* and 533*b*, respectively. Each of the first and second attachment portions 534*a* and 534*b* has a plurality (two) of attachment holes 535*a* and 535*b*, respectively.

As seen in FIG. 21, a rear boot strap 537 is connected between the first and second attachment portions 534*a* and 534*b* of the first and second strap attachment members 529*a* and 529*b*. The rear boot strap 537 extends across the front ankle section of the upper portion 524 of the snowboard boot 514. Preferably, the rear boot strap 537 is constructed of two boot strap section 537*a* and 537*b* that are coupled together by a buckle 537*c* for adjusting the longitudinal length of the rear boot strap 537 between the first and second attachment portions 534*a* and 534*b*. More specifically, the first and second boot strap sections 537*a* and 537*b* have their first ends fixedly coupled to the first and second attachment portions 534*a* and 534*b* via fasteners 539 (only one shown) and their second ends adjustably coupled to each other by the buckle 537*c*.

The outer sole 522*b* is molded around the peripheral edge of the base portion 527 of the mid sole 522*a* and extends upwardly from the peripheral edge of the base portion 527 to be fixedly coupled to the foot section 524*a* of the upper portion 524. Moreover, the outer sole 522*b* is molded to surround the first and second rear catches 528*a* and 528*b* and to overlie a portion of the first and second flexible connecting portions 533*a* and 533*b* of the first and second strap attachment members 529*a* and 529*b*. Thus, the outer sole 522*b* provides additional support to the first and second rear catches 528*a* and 528*b* as well as additional support for the first and second strap attachment members 529*a* and 529*b*.

Referring again to FIGS. 21 and 22, the snowboard binding 512 is preferably a highback binding that applies a forward leaning force on the snowboard boot 514. The snowboard binding 512 uses many of the same parts as the first embodiment. Thus, the parts of the snowboard binding 512 that are identical to the parts of the snowboard binding 12 of the first embodiment will be given the same reference numerals. Moreover, the modifications (the second, third and fourth embodiments) to the first embodiment can also be applied to the snowboard binding 512.

The snowboard binding 512 is attached to the top or upper surface of the snowboard 16 via four fasteners or screws 18 in a conventional manner. The longitudinal axis of the snowboard 16 is represented by the centerline A in FIG. 21. The snowboard binding 512 basically has a base member 40, a front binding member 542 and a pair (first and second) of rear binding members 44*a* and 44*b* that form a rear binding arrangement. The base member 40 has a front portion, a rear portion and a longitudinal axis B extending between the front and rear portions. The front binding member 542 is movably coupled to the base member 40 between a release position and a latched position. The pair (first and second) of rear binding members 44*a* and 44*b* are coupled to opposite lateral sides of the base member 40 as discussed in more detail above.

As in the first embodiment discussed above, the base member 40 of the fifth embodiment basically includes a base plate 46 adjustably coupled to the snowboard 16 via the adjustment disk 20, a heel cup 48 adjustably coupled to the base plate 46 and a highback 50 adjustably coupled to the heel cup 48. The snowboard binding 512 is preferably adjustably coupled to the snowboard 16 via the adjustment disk 20. The rear binding members 44*a* and 44*b* are movable relative to the base member 40 to selectively hold the snowboard boot 514 thereto. The rear binding members 44*a* and 44*b* are arranged to move laterally apart relative to each other from the initial rest positions to the guide positions upon application of a force in a direction substantially towards the base member 40 in the same manner as the first embodiment discussed above. The rear binding members 44*a* and 44*b* are also arranged to move laterally toward each other or together to one of the locked positions upon removal of the force in the same manner as the first embodiment discussed above. Thus, the rear binding members 44*a* and 44*b* are arranged to selectively hold the snowboard boot 514 in a plurality of engagement or locked positions having different heights above the base member 40 in the same manner as the first embodiment discussed above.

Figure 22:
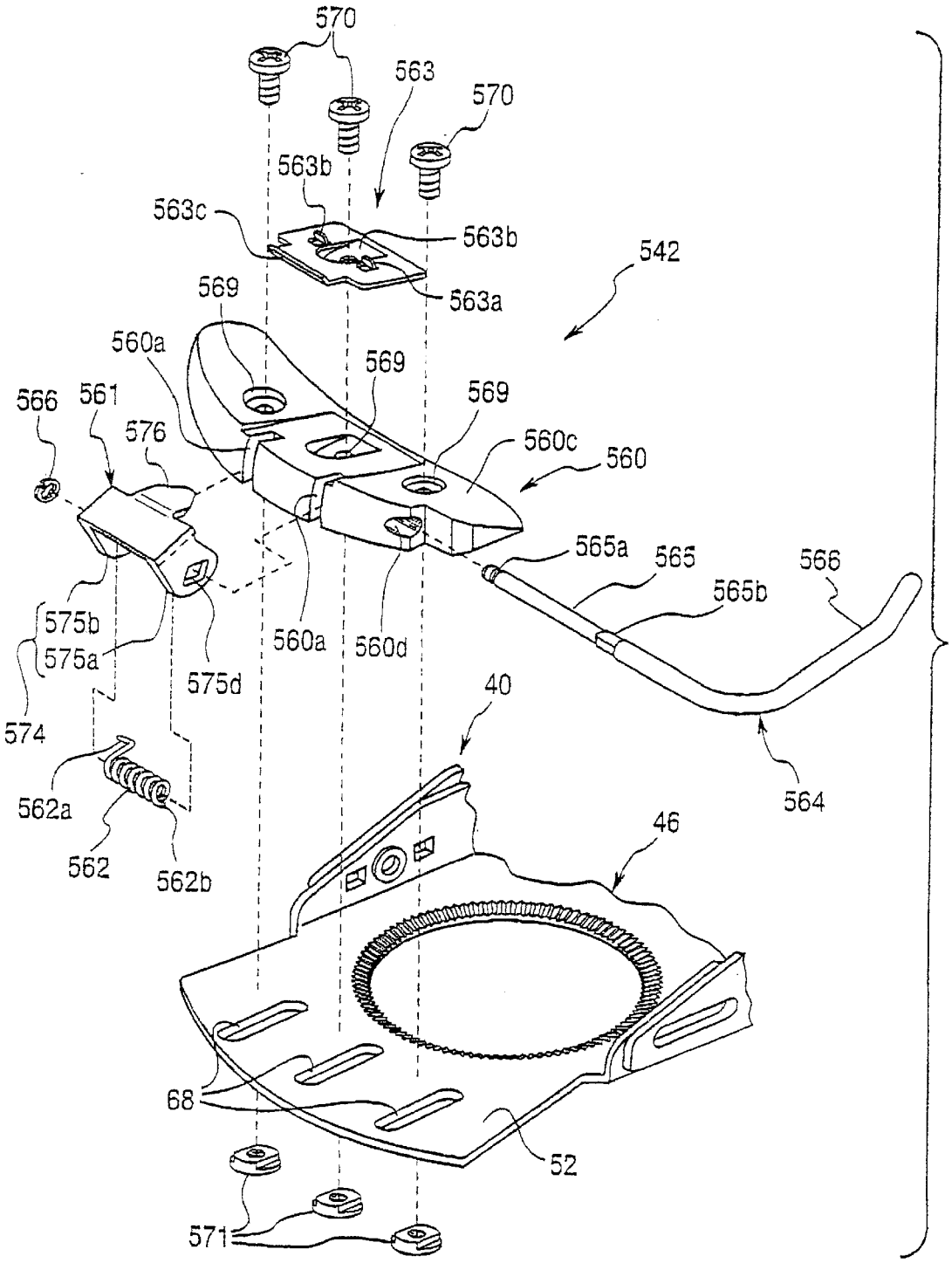
FIG. 22 is a partially exploded perspective view of the front binding member for the snowboard binding illustrated in FIG. 21.
Figure 23:
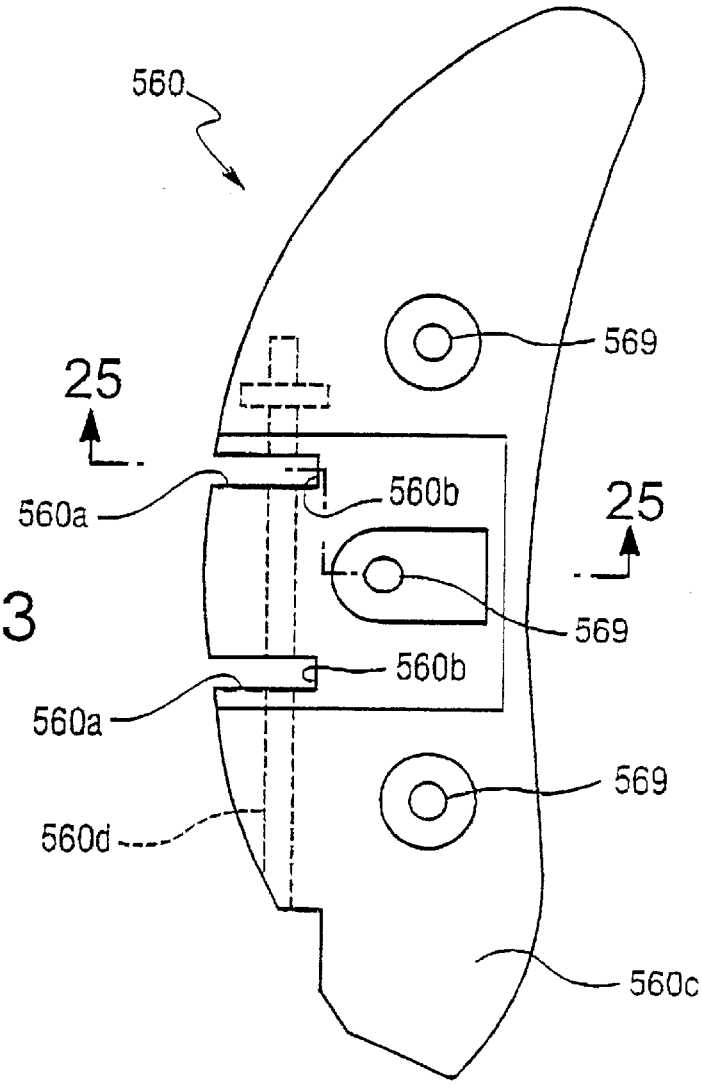
FIG. 23 is a top plan view of the front binding plate of the front binding member for the snowboard binding illustrated in FIG. 21.
Figure 24:
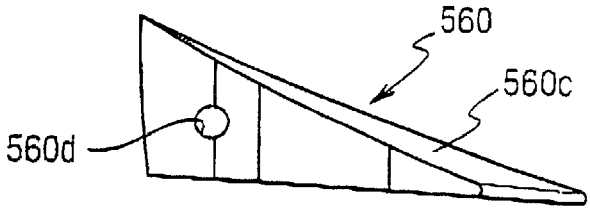
FIG. 24 is a side elevational view of the front binding plate illustrated in FIG. 23 for the snowboard binding illustrated in FIG. 21.
Figure 25:
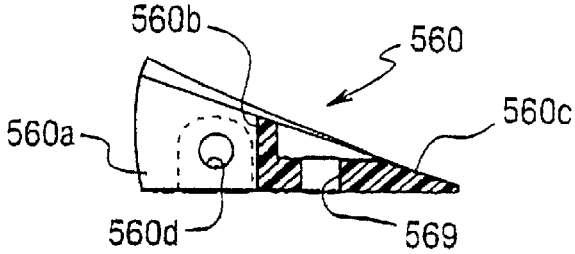
FIG. 25 is a cross sectional view of the front binding plate illustrated in FIGS. 23 and 24 for the snowboard binding illustrated in FIG. 21 as seen along section line 25—25 of FIG. 23.
Figure 26:
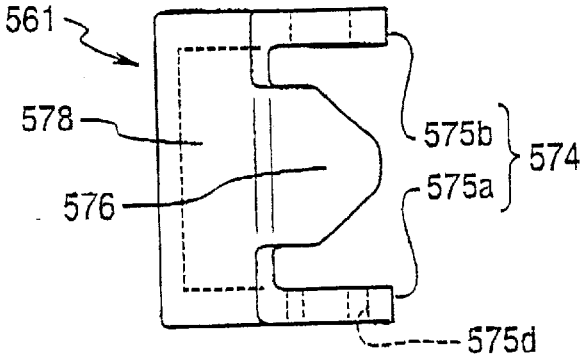
FIG. 26 is a top plan view of the front pawl of the front binding member for the snowboard binding illustrated in FIG. 21.
Figure 27:
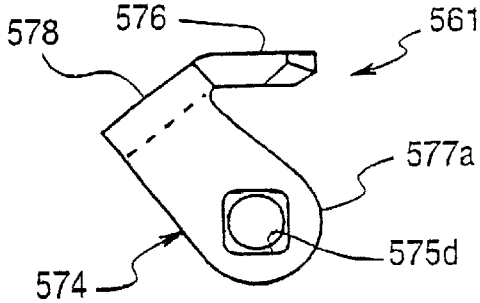
FIG. 27 is a side elevational view of the front pawl illustrated in FIG. 26 for the snowboard binding illustrated in FIG. 21.

As best seen in FIG. 22, the front binding member 542 basically includes a front binding plate 560, a front pawl 561, a front biasing member 562, a front stop member 563 and the release lever 564. The front pawl 561 is movably coupled to the front portion of the base member 40 between a release position and a latched position by the front binding plate 560. The front stop member 563 is fixedly coupled to the front portion of the base member 40 adjacent the front pawl 561 by the front binding plate 560.

As seen in FIGS. 21, the mounting portion 52 of the base plate 46 has the front binding plate 560 fixedly coupled thereto to form a front portion of the base plate 46. The front pawl 561 is movably coupled to the binding plate 560. Thus, when the front binding plate 560 is fixedly coupled to the mounting portion 52, the front pawl 561 is movably (pivotally) coupled to the base plate 46 of the base member 40. The front pawl 561 is preferably pivotally coupled to the front binding plate 560 via the front release lever 564 which functions as a front pivot pin for the front pawl 561. The biasing member 562 is arranged on the front release lever 564 to bias the front pawl 561 toward an engaged or latched position. The control or release lever 564 is preferably non-rotatably coupled to the front pawl 561 to move the front pawl 561 against the biasing or urging force of the biasing member or spring 562 from the latched position toward the release position.

As best seen in FIGS. 22–25, the binding plate 560 includes a pair of openings or slots 560*a* formed therein, which are configured to partially receive the front pawl 561. The slots 560*a* form a pair of stop surfaces 560*b* located at the rearmost edges of the slots 560*a*. The stop surfaces 560*b* normally hold the front pawl 561 in the latched position. Moreover, because the pivot axis of the front pawl 561 is below bottom surface of the binding plate 560, the front pawl 561 can rotate out of contact with the front catch 526. The bottom surface of base member 40 forms an additional stop surface when the front pawl 561 is in the release position. In this manner, the front pawl 561 can rotate about ninety degrees from the latched position where the front binding flange 576 is substantially horizontal to the release position where the front binding flange 576 is substantially vertical.

The front binding plate 560 has an inclined upper surface 560*c* that slopes upwardly along the longitudinal axis B of the base member 40 as the inclined upper surface 560*c* extends towards a front end of the base member 40.

Additionally, as best seen in FIGS. 21 and 22, the front binding plate 560 is preferably adjustable (along longitudinal axis B) relative to the mounting portion 52 of the base plate 46. More specifically, the mounting portion 52 includes a plurality (three) of slots 68, while the binding plate 560 includes a plurality (three) through holes 569. The fasteners or attachment screws 570 are inserted through the holes 569 and the slots 68 and attached to the nuts 571 to fixedly couple the front binding plate 560 to the mounting portion 52 in an adjustable manner along longitudinal axis B of the base member 40. Thus, the front binding member 542 can be selectively coupled at different longitudinal positions relative to base member 40. Of course, it will be apparent to those skilled in the art that various other structures could be utilized to adjust the longitudinal position of the front binding member 542. Moreover, it will be apparent to those skilled in the art that the binding plate 560 could be integrally formed with the base plate 46 if needed and/or desired.

As best seen in FIGS. 21, 22, 26 and 27, the front pawl 561 is an inverted U-shaped member having a mounting portion 574, a binding flange 576 and a connecting portion 578. The front pawl 561 is urge to the latched position by the biasing member or spring 562 so as to position the binding flange 576 above the ramp surface of the front stop member 563. The binding flange 576, the ramp surface 563*c* and the tabs or stops 563*b* form a front cleat receiving area therebetween. The release lever 564 is fixedly coupled to the front pawl 561 to move the front pawl 561 from the latched position to the release position upon application of a force on the release lever 564 that is greater than the urging force of the front biasing member or spring 562.

Figure 28:
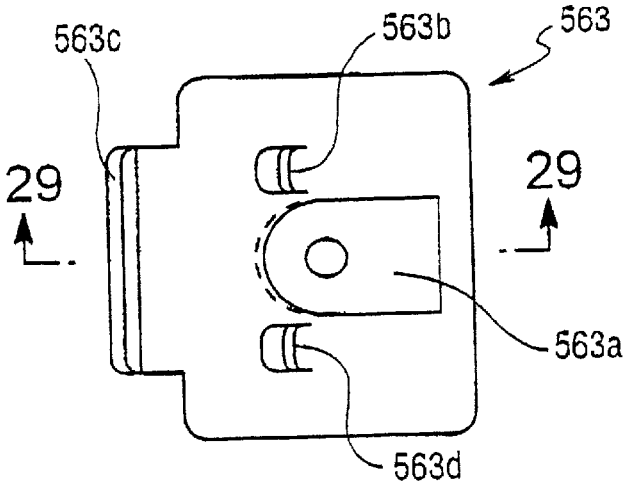
FIG. 28 is a top plan view of the front stop member of the front binding member for the snowboard binding illustrated in FIG. 21.
Figure 29:
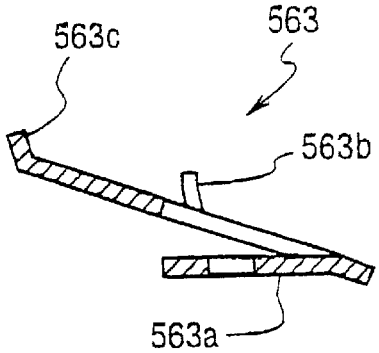
FIG. 29 is a cross sectional view of the front stop member illustrated in FIG. 28 for the snowboard binding illustrated in FIG. 21 as seen along section line 29—29 of FIG. 28.
Figure 30:
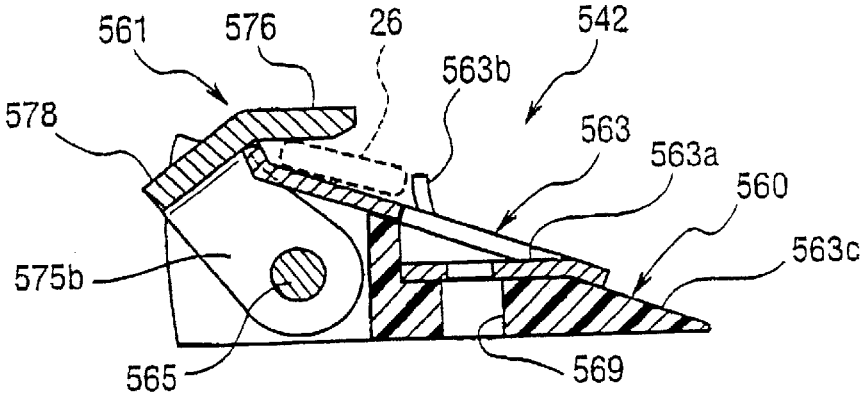
FIG. 30 is a cross sectional view of the front binding member for the snowboard binding illustrated in FIG. 21 as seen along section line 30—30 of FIG. 21.
Figure 31:
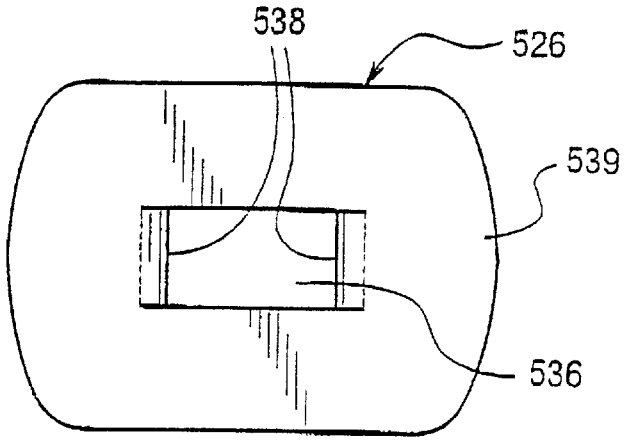
FIG. 31 is a top plan view of the front catch for the snowboard boot illustrated in FIG. 21.
Figure 32:
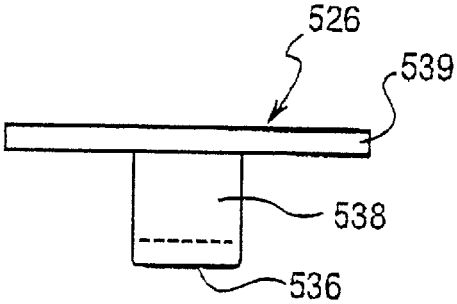
FIG. 32 is a side elevational view of the front catch illustrated in FIG. 31 for the snowboard boot illustrated in FIG. 21.

As best seen in FIGS. 28–30 the front stop member 563 is preferably a metal plate member that is bent to form a mounting plate 563*a* with a pair of tabs or stops 563*b* and a ramp surface 563*c*. The mounting plate 563*a* of the front stop member 563 is fixedly coupled to the front binding plate 560 and the mounting portion 52 of the base plate 46 by one of the fasteners or attachment screws 570. The tabs or stops 563*b* form a forwardly facing stop surface that is spaced rearwardly from the latching surface of the front pawl 561 to define part of the front cleat receiving area therebetween. The ramp surface 563*c* extending upwardly at an acute angle from mounting plate 563*a*. When the front stop member 563 is mounted on the base member 40, the ramp surface 563*c* is inclined upwardly relative to the base member 40 to assist in the release of the front catch 526 from the front pawl 561.

As best seen in FIG. 22, the release lever 564 basically includes a pivot pin section 565 pivotally supported in bore 560*d*, and a handle or control section 566 extending perpendicularly from the pivot pin section 565. In other words, the pivot pin section 565 of the release lever 564 forms the front pivot pin of the front pawl 561. Thus, the release lever 564 is integrally formed as a one-piece, unitary member. The pivot pin section 565 preferably includes an annular recess 65*a* formed at a free end thereof. A suitable retaining member or C-clip 566 is received in the annular recess 565*a* to secure the release lever 564 and the front pawl 561 to the binding plate 560, with the spring 562 arranged therebetween.

As best seen in FIGS. 21, 22, 26 and 27, the mounting portion 574 of the front pawl 561 is non-rotatably mounted on the pivot pin section 565 of the release lever 564 for rotation between a latched position and a release position about a front pivot axis. The front pivot axis is arranged below the binding plate 560 such that front pawl 561 can be moved out of engagement with the front catch 526 (i.e. to the release position). The biasing member or spring 562 applies an urging force on the front pawl 561 to urge the front pawl 561 to the latched position. The front pawl 561 includes a lower latching surface configured to engage an upper surface of the bight portion 536 of the front catch 526 of the snowboard boot 514. The connecting portion 578 extends between the binding plate 576 and the mounting portion 574.

More specifically, the mounting portion 574 is preferably formed of a pair (first and second) mounting flanges 575*a* and 575*b*. The mounting flange 575*a* is designed to engage a first end 562*a* of the spring 562. The other end (second end) 562*b* of spring 562 is designed to be received in a transverse hole (not shown) formed in the mounting plate 560. Thus, the spring 562 is preloaded to urge the front binding member 542 towards the latched position to selectively hold the front catch 526 of the snowboard boot 514. Additionally, at least one of the mounting flanges 575*a* and 575*b* preferably includes a non-circular (square) opening 575*d* to non-rotatably receive a non-circular portion 565*b* of the release lever 564.

Mounting and dismounting the snowboard boot 514 with the snowboard binding 512 will now be discussed in more detail. When the rider wants to enter the snowboard binding 512, the boot 514 should be slightly inclined. The front catch 526 is first engaged with the front pawl 561. Specifically, the front catch 526 is positioned beneath the front binding flange 576. Then the rider moves the rear portion of the snowboard boot 514 in a direction substantially towards the base plate 46. In other words, the snowboard boot 514 pivots rearwardly about the front catch 26 such that the rear of the boot 514 moves substantially toward the base member 40.

This movement of the snowboard boot 514 causes the rear binding members 44*a* and 44*b* to pivot against the biasing force of the springs 90*a* and 90*b*, respectively. Thus, the rear latch members 86*a* and 86*b* move laterally away from longitudinal axis B into guide positions (first and second guide positions, respectively) such that the snowboard boot 514 can be moved downwardly. Once the rear catches 528*a* and 528*b* move a predetermined distance, the rear latch members 86*a* and 86*b* move from the (first and second) guide positions to (first and second) locking positions. Thus, the snowboard boot 514 is in a first locked position. In this first locked position, the rear of the sole portion 522 is slightly spaced from the mounting portion 52 of the base plate 46. Thus an obstruction, such as snow, mud or sand can be accommodated if needed. The snowboard boot 14 can be further moved into a second locked position, if no obstruction prevents such movement. In this second locked position, the rear latch members 86*a* and 86*b* move from intermediate (first and second) guide positions (not shown) to additional (first and second) locking positions, respectively. Thus snowboard boot 514 is in a second locked position.

Release of the snowboard boot 514 from snowboard binding 512 will now be discussed in more detail. The snowboard binding 512 can easily release the snowboard boot 514 therefrom, when the snowboard boot 514 is in either of the locked positions. Specifically, the release lever 564 is pivoted in order to move the front pawl 561 from the latched position to the release position. Thus, the front catch 526 of the snowboard boot 514 is released from the snowboard binding 512. However, the rear binding members 44*a* and 44*b* remain in the engagement or locking positions. In order to completely, detach the snowboard boot 514 from snowboard binding 512, the snowboard boot 514 is then moved longitudinally (i.e. along longitudinal axis B) such that the rear pawls 86*a* and 86*b* slide in notches 530*a* and

530*b*, respectively. After the boot 514 is moved a sufficient distance, the rear pawls 86*a* and 86*b* will not engage or lock the notches 530*a* and 530*b*. Thus the snowboard boot 514 can be completely released from the snowboard binding 512.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A snowboard binding comprising:

a base member having a front portion, a rear portion and a longitudinal axis extending between said front and rear portions;

a rear binding arrangement coupled to said rear portion of said base member; and a front binding member including a front pawl movably coupled to said front portion of said base member between a release position and a latched position and a front stop member fixedly coupled to said front portion of said base member adjacent said front pawl, said front stop member having a stop surface spaced rearwardly from a latching surface of said front pawl to form a front cleat receiving area therebetween, said stop surface being arranged and configured to prevent rearward longitudinal movement of a front catch of a snowboard boot when the front catch is located in said cleat receiving area.

2. A snowboard binding according to claim 1, wherein said front binding member further includes a front biasing member that applies an urging force on said front pawl to urge said front pawl to said latched position, and a release lever coupled to said front pawl to move said front pawl from said latched position to said release position upon application of a force on said release lever that is greater than said urging force of said front biasing member.

3. A snowboard binding according to claim 1, wherein said rear binding arrangement includes a first rear binding member coupled to a first lateral side of said rear portion of said base member.

4. A snowboard binding according to claim 1, wherein said rear binding arrangement is longitudinally adjustable relative to said rear portion of said base member such that said rear binding arrangement can be selectively coupled at different longitudinal positions relative to said base member.

5. A snowboard binding according to claim 2, wherein said front binding member includes a front binding plate fixedly coupled to said front portion of said base member with said front pawl pivotally supported on said front binding plate.

6. A snowboard binding according to claim 2, wherein said front binding member further includes a ramp surface inclined upwardly relative to said base member.

7. A snowboard binding according to claim 3, wherein said first rear binding member includes a first latch member movable relative to said base member, said first latch member being pivotally supported about a first pivot axis substantially parallel to said longitudinal axis, said first latch member being arranged to move laterally upon application of a first force in a direction substantially towards said base member.

8. A snowboard binding according to claim 5, wherein said front stop member is fixedly coupled to said front binding plate.

9. A snowboard binding according to claim 6, wherein said front stop member includes a mounting plate with said ramp surface extending upwardly therefrom.

10. A snowboard binding according to claim 7, further comprising said rear binding arrangement further includes a second rear binding member coupled to a second lateral side of said rear portion of said base member, said second rear binding member including a second latch member movable relative to said base member, said second latch member being pivotally supported about a second pivot axis substantially parallel to said longitudinal axis, said second latch member being arranged to move laterally upon application of a second force in said direction substantially towards said base member.

11. A snowboard binding according to claim 8, wherein said front binding plate has an inclined upper surface that slopes upwardly along said longitudinal axis of said base member as said inclined upper surface extends towards a front end of said base member.

12. A snowboard binding according to claim 10, wherein said first and second latch members are arranged to move laterally apart relative to each other from first and second initial positions to first and second guide positions upon application of said first and second forces in said direction substantially towards said base member and then to move from said first and second guide positions to first and second locking positions to selectively hold a portion of a snowboard boot.

13. A snowboard binding according to claim 10, wherein said base member includes a mounting portion and a pair of side attachment portions extending perpendicularly from said mounting portion, said side attachment portions having said first and second latch members coupled thereto, respectively.

14. A snowboard binding according to claim 10, wherein said first and second rear binding members are mounted on support members that are slanted upwardly and outwardly relative to said base member.

15. A snowboard binding according to claim 12, wherein said first and second latch members are first and second pawls that are normally urged by first and second biasing members from said first and second guide positions to first and second locking positions, respectively, said first pawl includes a first locking surface and a first guide surface, said second pawl includes a second locking surface and a second guide surface.

16. A snowboard binding according to claim 13, wherein said base member further includes a highback support extending upwardly relative to said rear portion of said base member.

17. A snowboard binding according to claim 14, wherein said support members are part of a heel cup with a highback support mounted thereto.

18. A snowboard binding according to claim 15, wherein said first pawl is pivotally supported about said first pivot axis, and said second pawl is pivotally supported about said second pivot axis.

19. A snowboard binding comprising:

a base member having a front portion, a rear portion and a longitudinal axis extending between said front and rear portions;

a rear binding arrangement coupled to said rear portion of said base member; and a front binding member including a front pawl movably coupled to said front portion of said base member between a release position and a latched position and a front stop member fixedly coupled to said front portion of said base member adjacent said front pawl, said front stop member having a stop surface spaced from a latching surface of said front pawl to form a front cleat receiving area therebetween, said front binding member further including a front biasing member that applies an urging force on said front pawl to urge said front pawl to said latched position, a release lever coupled to said front pawl to move said front pawl from said latched position to said release position upon application of a force on said release lever that is greater than said urging force of said front biasing member, and a front binding plate fixedly coupled to said front portion of said base member with said front pawl pivotally supported on said front binding plate, said front stop member being fixedly coupled to said front binding plate, said front binding plate having an inclined upper surface that slopes upwardly along said longitudinal axis of said base member as said inclined upper surface extends towards a front end of said base member, said front binding plate being is longitudinally adjustable relative to said front portion of said base member such that said front binding member can be selectively coupled at different longitudinal positions relative to said base member.

20. A snowboard binding comprising:

a base member having a front portion, a rear portion and a longitudinal axis extending between said front and rear portions;

a rear binding arrangement coupled to said rear portion of said base member; and a front binding member including a front pawl movably coupled to said front portion of said base member between a release position and a latched position and a front stop member fixedly coupled to said front portion of said base member adjacent said front pawl, said front stop member having a stop surface spaced from a latching surface of said front pawl to form a front cleat receiving area therebetween, said front binding member further including a front biasing member that applies an urging force on said front pawl to urge said front pawl to said latched position, a release lever coupled to said front pawl to move said front pawl from said latched position to said release position upon application of a force on said release lever that is greater than said urging force of said front biasing member, and a ramp surface inclined upwardly relative to said base member, said front stop member including a mounting plate with said ramp surface extending upwardly therefrom, said stop surface of said front stop member being formed by at least one tab that extends upwardly from said mounting plate.

21. A snowboard binding according to claim 20, wherein said front binding member includes a front binding plate fixedly coupled to said front portion of said base member with said front pawl pivotally supported on said front binding plate and said front stop member fixedly coupled to said front binding plate.

22. A snowboard binding according to claim 21, wherein said front binding plate has an inclined upper surface that slopes upwardly along said longitudinal axis of said base member as said inclined upper surface extends towards a front end of said base member, said mounting plate of said front stop member being secured to said inclined upper surface of said front binding plate.

23. A snowboard binding according to claim 22, wherein said front binding plate is longitudinally adjustable relative to said front portion of said base member such that said front binding member can be selectively coupled at different longitudinal positions relative to said base member.

24. A snowboard binding system comprising:

a snowboard boot having a sole portion, a front catch located at a front part of said sole portion, a rear catch located at a rear section of said sole portion; and a snowboard binding configured to be releasable coupled to said snowboard boot, said snowboard binding including a base member having a front portion, a rear portion and a longitudinal axis extending between said front and rear portions;

a rear binding arrangement coupled to said rear portion of said base member to selectively engage said rear catch; and a front binding member including a front pawl movably coupled to said front portion of said base member between a release position and a latched position and a front stop member fixedly coupled to said front portion of said base member adjacent said front pawl, said front stop member having a stop surface spaced rearwardly from a latching surface of said front pawl to form a front cleat receiving area therebetween, said stop surface being arranged and configured to prevent rearward movement of said front catch of said snowboard boot when the front catch is located in said cleat receiving area.

25. A snowboard binding system according to claim 24, wherein said front binding member further includes a front biasing member that applies an urging force on said front pawl to urge said front pawl to said latched position, and a release lever coupled to said front pawl to move said front pawl from said latched position to said release position upon application of a force on said release lever that is greater than said urging force of said front biasing member.

26. A snowboard binding system according to claim 24, wherein said rear binding arrangement includes a first rear binding member coupled to a first lateral side of said rear portion of said base member.

27. A snowboard binding system according to claim 24, wherein said rear binding arrangement is longitudinally adjustable relative to said rear portion of said base member such that said rear binding arrangement can be selectively coupled at different longitudinal positions relative to said base member.

28. A snowboard binding system according to claim 25, wherein said front binding member includes a front binding plate fixedly coupled to said front portion of said base member with said front pawl pivotally supported on said front binding plate.

29. A snowboard binding system according to claim 25, wherein said front binding member further includes a ramp surface inclined upwardly relative to said base member.

30. A snowboard binding system according to claim 26, wherein said first rear binding member includes a first latch member movable relative to said base member, said first latch member being pivotally supported about a first pivot axis substantially parallel to said longitudinal axis, said first latch member being arranged to move laterally upon application of a first force in a direction substantially towards said base member.

31. A snowboard binding system according to claim 28, wherein said front stop member is fixedly coupled to said front binding plate.

32. A snowboard binding system according to claim 29, wherein said front stop member includes a mounting plate with said ramp surface extending upwardly therefrom.

33. A snowboard binding system according to claim 31, wherein said front binding plate has an inclined upper surface that slopes upwardly along said longitudinal axis of said base member as said inclined upper surface extends towards a front end of said base member.

34. A snowboard binding system according to claim 30, further comprising said rear binding arrangement further includes a second rear binding member coupled to a second lateral side of said rear portion of said base member, said second rear binding member including a second latch member movable relative to said base member, said second latch member being pivotally supported about a second pivot axis substantially parallel to said longitudinal axis, said second latch member being arranged to move laterally upon application of a second force in said direction substantially towards said base member.

35. A snowboard binding system according to claim 34, wherein said first and second latch members are arranged to move laterally apart relative to each other from first and second initial positions to first and second guide positions upon application of said first and second forces in said direction substantially towards said base member and then to move from said first and second guide positions to first and second locking positions to selectively hold a portion of a snowboard boot.

36. A snowboard binding system according to claim 34, wherein said base member includes a mounting portion and a pair of side attachment portions extending perpendicularly from said mounting portion, said side attachment portions having said first and second latch members coupled thereto, respectively.

37. A snowboard binding system according to claim 34, wherein said first and second rear binding members are mounted on support members that are slanted upwardly and outwardly relative to said base member.

38. A snowboard binding system according to claim 35, wherein said first and second latch members are first and second pawls that are normally urged by first and second biasing members from said first and second guide positions to first and second locking positions, respectively, said first pawl includes a first locking surface and a first guide surface, said second pawl includes a second locking surface and a second guide surface.

39. A snowboard binding system according to claim 38, wherein said first pawl is pivotally supported about said first pivot axis, and said second pawl is pivotally supported about said second pivot axis.

40. A snowboard binding system according to claim 36, wherein said base member further includes a highback support extending upwardly relative to said rear portion of said base member.

41. A snowboard binding system according to claim 37, wherein said support members are part of a heel cup with a highback support mounted thereto.

42. A snowboard binding system comprising:

a snowboard boot having a sole portion, a front catch located at a front part of said sole portion, a rear catch located at a rear section of said sole portion; and a snowboard binding configured to be releasable coupled to said snowboard boot, said snowboard binding including a base member having a front portion, a rear portion and a longitudinal axis extending between said front and rear portions;

a rear binding arrangement coupled to said rear portion of said base member to selectively engage said rear catch; and a front binding member including a front pawl movably coupled to said front portion of said base member between a release position and a latched position and a front stop member fixedly coupled to said front portion of said base member adjacent said front pawl, said front stop member having a stop surface spaced from a latching surface of said front pawl to form a front cleat receiving area therebetween, said front binding member further including a front biasing member that applies an urging force on said front pawl to urge said front pawl to said latched position, and a release lever coupled to said front pawl to move said front pawl from said latched position to said release position upon application of a force on said release lever that is greater than said urging force of said front biasing member and a front binding plate fixedly coupled to said front portion of said base member with said front pawl pivotally supported on said front binding plate, said front stop member being fixedly coupled to said front binding plate, said front binding plate having an inclined upper surface that slopes upwardly along said longitudinal axis of said base member as said inclined upper surface extends towards a front end of said base member, said front binding plate being longitudinally adjustable relative to said front portion of said base member such that said front binding member can be selectively coupled at different longitudinal positions relative to said base member.

43. A snowboard binding system comprising:

a snowboard boot having a sole portion, a front catch located at a front part of said sole portion, a rear catch located at a rear section of said sole portion; and a snowboard binding configured to be releasable coupled to said snowboard boot, said snowboard a including base member having a front portion, a rear portion and a longitudinal axis extending between said front and rear portions;

a rear binding arrangement coupled to said rear portion of said base member to selectively engage said rear catch; and a front binding member including a front pawl movably coupled to said front portion of said base member between a release position and a latched position and a front stop member fixedly coupled to said front portion of said base member adjacent said front pawl, said front stop member having a stop surface spaced from a latching surface of said front pawl to form a front cleat receiving area therebetween, said front binding member further including a front biasing member that applies an urging force on said front pawl to urge said front pawl to said latched position, and a release lever coupled to said front pawl to move said front pawl from said latched position to said release position upon application of a force on said release lever that is greater than said urging force of said front biasing member, and a ramp surface inclined upwardly relative to said base member, said front stop member including a mounting plate with said ramp surface extending upwardly therefrom said stop surface of said front stop member being formed by at least one tab that extends upwardly from said mounting plate.

44. A snowboard binding system according to claim 43, wherein said front binding member includes a front binding plate fixedly coupled to said front portion of said base member with said front pawl pivotally supported on said front binding plate and said front stop member fixedly coupled to said front binding plate.

45. A snowboard binding system according to claim 44, wherein said front binding plate has an inclined upper surface that slopes upwardly along said longitudinal axis of said base member as said inclined upper surface extends towards a front end of said base member, said mounting plate of said front stop member being secured to said inclined upper surface of said front binding plate.

46. A snowboard binding system according to claim 45, wherein said front binding plate is longitudinally adjustable relative to said front portion of said base member such that said front binding member can be selectively coupled at different longitudinal positions relative to said base member.

* * * * *